US012716319B1

(12) United States Patent
Arabie et al.

(10) Patent No.: US 12,716,319 B1
(45) Date of Patent: Aug. 25, 2026

(54) RETRIEVABLE PACKER AND BRIDGE PLUG APPARATUS AND METHOD FOR USING SAME

(71) Applicant: Oilfield Service Professionals, Inc., Houston, TX (US)

(72) Inventors: Blake L. Arabie, Rayne, LA (US); Scotty Verret, Carencro, LA (US)

(73) Assignee: Oilfield Service Professionals, Inc., Houston, TX (US)

( * ) Notice: Subject to any disclaimer, the term of this patent is extended or adjusted under 35 U.S.C. 154(b) by 168 days.

(21) Appl. No.: 18/602,804

(22) Filed: Mar. 12, 2024

Related U.S. Application Data

(60) Provisional application No. 63/489,869, filed on Mar. 13, 2023.

(51) Int. Cl.
*E21B 33/129* (2006.01)
*E21B 23/00* (2006.01)
*E21B 33/128* (2006.01)

(52) U.S. Cl.
CPC ..... *E21B 33/1293* (2013.01); *E21B 23/006* (2013.01); *E21B 33/128* (2013.01)

(58) Field of Classification Search
CPC .... E21B 33/1293; E21B 33/129; E21B 33/12; E21B 33/122; E21B 33/124; E21B 33/12981; E21B 33/1295; E21B 33/128; E21B 23/006; E21B 23/004
See application file for complete search history.

(56) References Cited

U.S. PATENT DOCUMENTS

2005/0077048 A1* 4/2005 Hall ..... E21B 23/006 166/342
2015/0376975 A1* 12/2015 Flores ..... E21B 33/128 166/185
2019/0284898 A1* 9/2019 Fagna ..... E21B 33/1204
2021/0010344 A1* 1/2021 Hrupp ..... E21B 33/1285
2022/0403713 A1* 12/2022 Stolboushkin ..... E21B 34/10

* cited by examiner

*Primary Examiner* — Kristyn A Hall
(74) *Attorney, Agent, or Firm* — Ted M. Anthony; Sarah B. Dupont

(57) ABSTRACT

A modular packer/bridge plug apparatus combines functionality of retrievable packer and retrievable bridge plug, fully deployable as a single modular assembly, yet has features that are capable of being independently and selectively operated. A bridge plug feature can be selectively "locked out" when desired, while a retrievable packer feature can operate independently of the bridge plug. The modular packer/bridge plug apparatus reduces the need for separate equipment on a drilling rig or other work location.

2 Claims, 19 Drawing Sheets

RETRIEVABLE PACKER AND BRIDGE PLUG APPARATUS AND METHOD FOR USING SAME

CROSS REFERENCES TO RELATED APPLICATION

THIS APPLICATION CLAIMS PRIORITY OF U.S. PROVISIONAL PATENT APPLICATION Ser. No. 63/489,869, FILED Mar. 13, 2023, INCORPORATED BY REFERENCE HEREIN.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to a modular and retrievable tool for use downhole in oil and gas wells. More particularly, the present invention pertains to a retrievable modular packer and bridge plug assembly that can be used to selectively perform multiple downhole operations in a wellbore.

2. Description of Related Art

Packers generally comprise tools used in the oilfield to isolate certain downhole section(s) of a wellbore (such as, for example, a portion of a well passing through a subterranean reservoir) from certain other downhole section(s) within said wellbore (such as, for example, a portion of a well passing through a different subterranean reservoir). Generally, packers can be "permanent" or "retrievable". Permanent packers are designed for a single use in a wellbore, while retrievable packers are designed to be used multiple times over the life of the packer.

Retrievable packers are typically conveyed into a wellbore and set at a desired location within said wellbore using a tubular string, such as drill pipe or work string. In most cases, when a packer is set within a wellbore, at least one slip system of the packer can be selectively engaged to frictionally anchor the packer against the inner surface of the surrounding wellbore to prevent unwanted movement of the packer within the wellbore. Additionally, rubber and/or other elastomeric sealing elements disposed on the packer expand radially outward to form a fluid pressure seal against said inner surface of said surrounding wellbore. After a packer has been set downhole within a wellbore, subsequent operations (such as, for example, treatment, completion, temporary abandonment, and/or other operations) can then be conducted within the wellbore.

Many different types of retrievable packers and associated setting systems exist. One such type of retrievable packer is known as a "compression-set packer" which is frequently used in offshore or other wells to isolate an upper section of a wellbore from a lower section of said wellbore. In order to selectively actuate a compression-set packer, some or all of the weight of a tubular string (such as drill pipe or work string used to convey said packer into a wellbore) is intentionally imparted or "set down" on the packer from above. Due to their robust construction and capacity to support axial loading, compression-set packers are sometimes used to hang a length of drill pipe (commonly known as "tailpipe") that extends from said packer deeper into said wellbore.

A bridge plug is another type of tool commonly used in oil and gas operations to isolate certain downhole region(s) of a wellbore from certain other downhole region(s) of said wellbore. A bridge plug can also be selectively set downhole at a desired location within a wellbore to establish a fluid pressure seal or pressure barrier within said wellbore. Some bridge plugs are designed to be retrievable from a wellbore, while others are intended to be permanently set in place. Regardless, bridge plugs typically cannot support significant axial loading, such as the weight of a tubular drill pipe or work string tailpipe.

Packers and bridge plugs are typically used for a variety of different reasons throughout the oil and gas industry. In some cases, it is desirable—and often necessary—to temporarily abandon a wellbore and secure said wellbore against unwanted (and frequently uncontrolled) fluid flow from subterranean formations. By way of illustration, but not limitation, in marine applications it is frequently necessary to move a floating drilling rig or other vessel when inclement weather is approaching; however, said drilling rig or other vessel cannot be safely moved until after any well being drilled or serviced is properly secured. In such cases, a packer and/or bridge plug can be used to temporarily abandon a well and secure said well against unwanted fluid flow from said wellbore, thereby permitting said drilling vessel and/or other surface equipment to be moved off of the drilling location without pulling the entire drill string from the well.

In some jurisdictions, certain governmental and/or regulatory authorities require drilling rigs to have packers and/or bridge plugs on location (on a drilling rig) and readily available for use in such situations. However, because packers and plugs are separate and distinct from one another, users are frequently required to maintain multiple different inventory and accessory configurations on a drilling rig or other location. Even in non-emergency situations, users may be required to maintain multiple different packers and plugs in order to accommodate various possible "normal" applications such as, for example, casing testing, cement squeeze jobs, and other downhole intervention applications. In such cases, costs are incurred, even when said accessories are only in "stand-by" mode and are not actually being used on location.

Thus, there is a need for a modular downhole apparatus that can perform the functions of retrievable packers and downhole bridge plugs, but without requiring multiple separate tools or accessory devices to accomplish said functions. The downhole apparatus should be effective and cost-efficient. Further, said downhole apparatus should be easy to selectively set at a desired location within a wellbore, and to retrieve from said wellbore when desired.

SUMMARY OF THE INVENTION

In a preferred embodiment, the present invention comprises a fully retrievable multi-use modular packer/bridge plug apparatus. Said modular packer/bridge plug apparatus of the present invention can perform multiple different functions associated with separate stand-alone retrievable packers and retrievable bridges plug, while being fully deployable as a modular apparatus that is capable of being independently and selectively operated. The modular packer/bridge plug apparatus of the present invention eliminates the need for maintaining additional equipment on a drilling rig or other work location, and particularly "standby" or unused equipment.

The modular packer/bridge plug apparatus of the present invention comprises a single tool that can offer functionality of both a retrievable packer and retrievable bridge plug, while permitting independent operation of each feature. In a preferred embodiment, bridge plug functionality of the present invention can be selectively "locked out" (including, without limitation, on a drilling rig or other remote location) when desired. For example, said bridge plug can be selectively locked out during operations wherein well abandonment is not contemplated including, without limitation, during casing testing, cement squeeze jobs, and the like. Put another way, the retrievable packer functionality of said modular packer/bridge plug apparatus can selectively operate independently of the plug functionality.

The modular packer/bridge plug apparatus of the present invention includes a robust bypass feature; said bypass feature is integral to said tool and does not require use of an accessory tool. Said bypass feature is desirable to ensure that high volume and/or high velocity fluid flow can selectively flow through the apparatus without compromising the integrity of said tool (and, in particular, rubber or elastomeric sealing elements thereof).

During abandonment operations or other circumstances wherein use of a bridge plug is desired, the bridge plug feature of the modular packer/bridge plug apparatus of the present invention can be selectively actuated to permit said abandonment or other operations to proceed. Further, said bridge plug feature can be selectively activated and/or deactivated multiple times (including, without limitation, during a single trip within a wellbore) utilizing the "lock out" feature of the modular packer/bridge plug apparatus. Further, an integral bypass can be independently opened or closed based on operational requirements/needs, regardless of whether the bridge plug feature is actuated. Said bypass permits circulation of drilling mud or other drilling fluid for maximum operational versatility including to ensure well control and pressure integrity.

Multiple components of the modular packer/bridge plug apparatus can be reconfigured in the field to permit the apparatus to be effectively operated in multiple different casing size ranges. Put another way, the modular packer/bridge plug apparatus of the present invention can be quickly and efficiently reconfigured from a first casing size to another casing size (including, without limitation, in the field) without removal and/or addition of specialized components to said apparatus. As a result, a single tool can be utilized for multiple different "casing string" runs without removing the modular packer/bridge plug apparatus from a location or requiring another separate apparatus to be brought in for use.

The modular packer/bridge plug apparatus of the present invention reduces costs associated with equipment rentals, increases overall safety (including safety related to long apparatus lifts) and provides a modular system that can perform multiple different applications with a single apparatus.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

Further, the drawings constitute a part of this specification and include exemplary embodiments of the technology. It is to be understood that in some instances, various aspects of the invention may be shown exaggerated or enlarged to facilitate an understanding of the invention. Therefore, the drawings may not be to scale.

(Note that FIGS. 9-13 may not depict all pins, set screws and/or similar known components for clarity)

Figure 14:
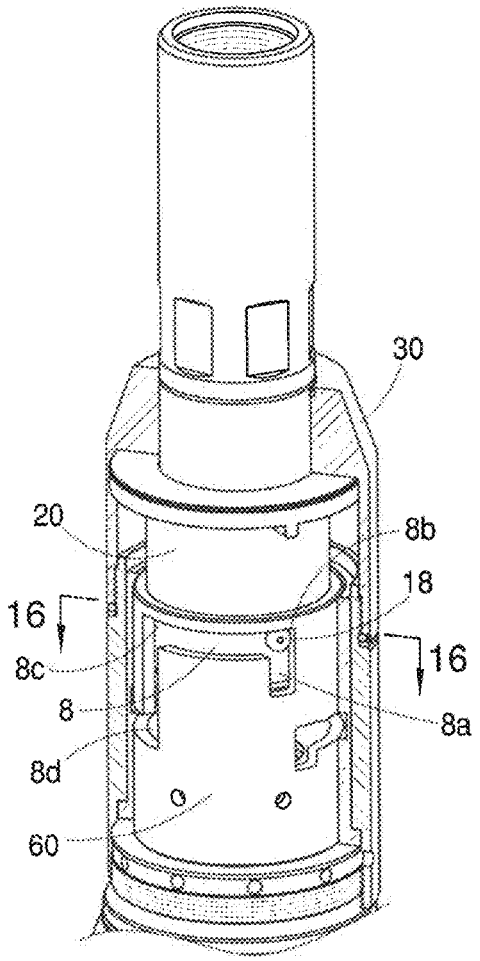

FIG. 14 depicts a side perspective and partial cut-away view of an upper portion and Z-slot of the retrievable modular packer/bridge plug apparatus of the present invention.

Figure 15:
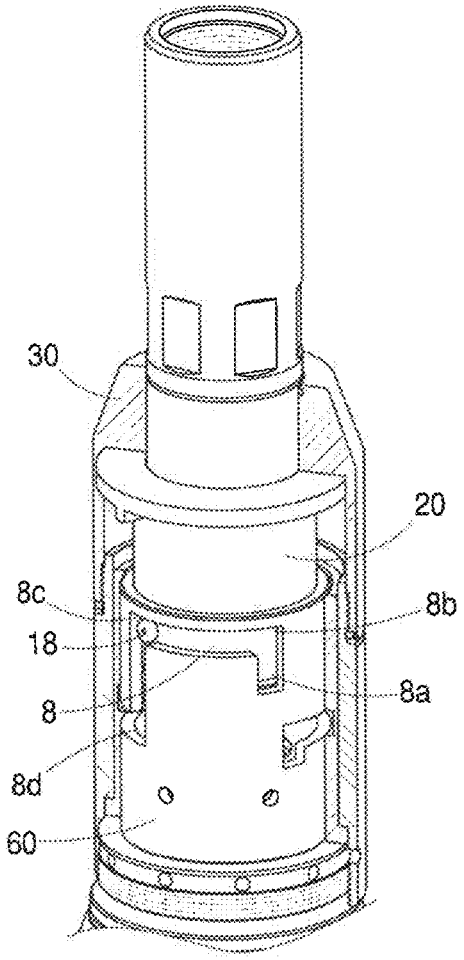

FIG. 15 depicts a side perspective and partial cut-away view of an upper portion and Z-slot of the retrievable modular packer/bridge plug apparatus of the present invention in a different position than depicted in FIG. 14.

Figure 16:
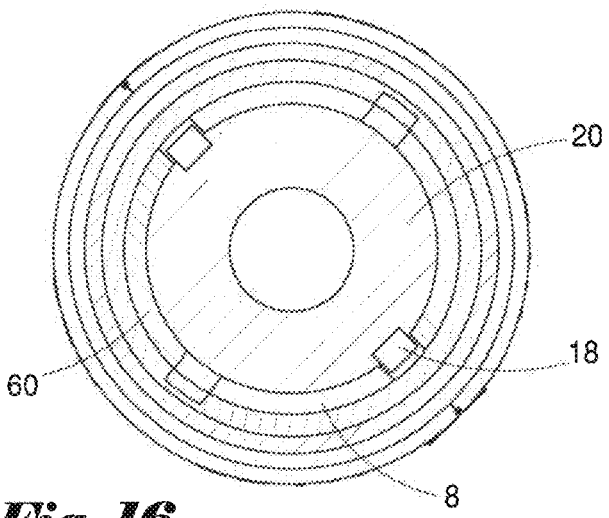

FIG. 16 depicts a sectional view of the retrievable modular packer/bridge plug apparatus of the present invention along line 16-16 of FIG. 14.

Figure 17:
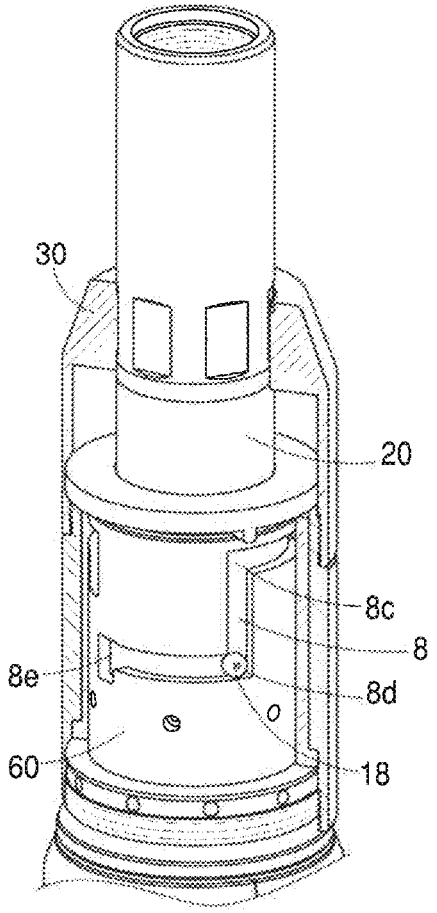

FIG. 17 depicts a side perspective and partial cut-away view of an upper portion and Z-slot of the modular packer/bridge plug apparatus of the present invention in a different position than depicted in FIGS. 14 and 15.

Figure 18:
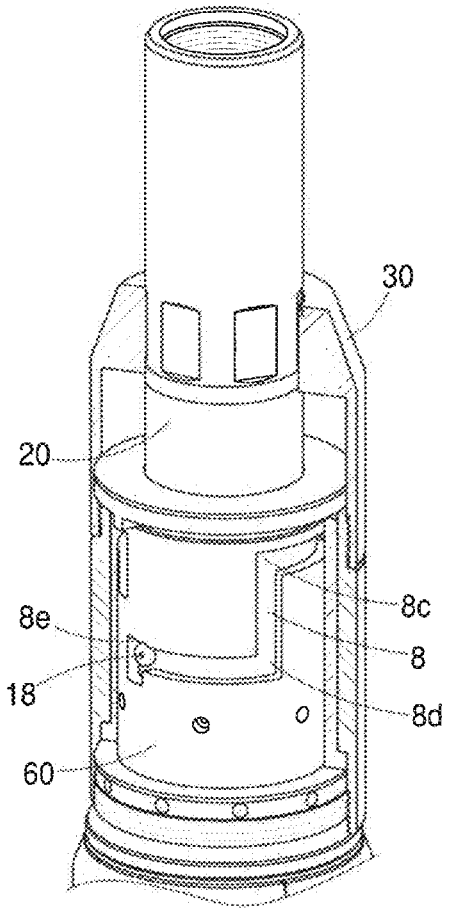

FIG. 18 depicts a side perspective and partial cut-away view of an upper portion and Z-slot of the retrievable modular packer/bridge plug apparatus of the present invention in a different position than depicted in FIGS. 14, 15 and 16.

Figure 19:
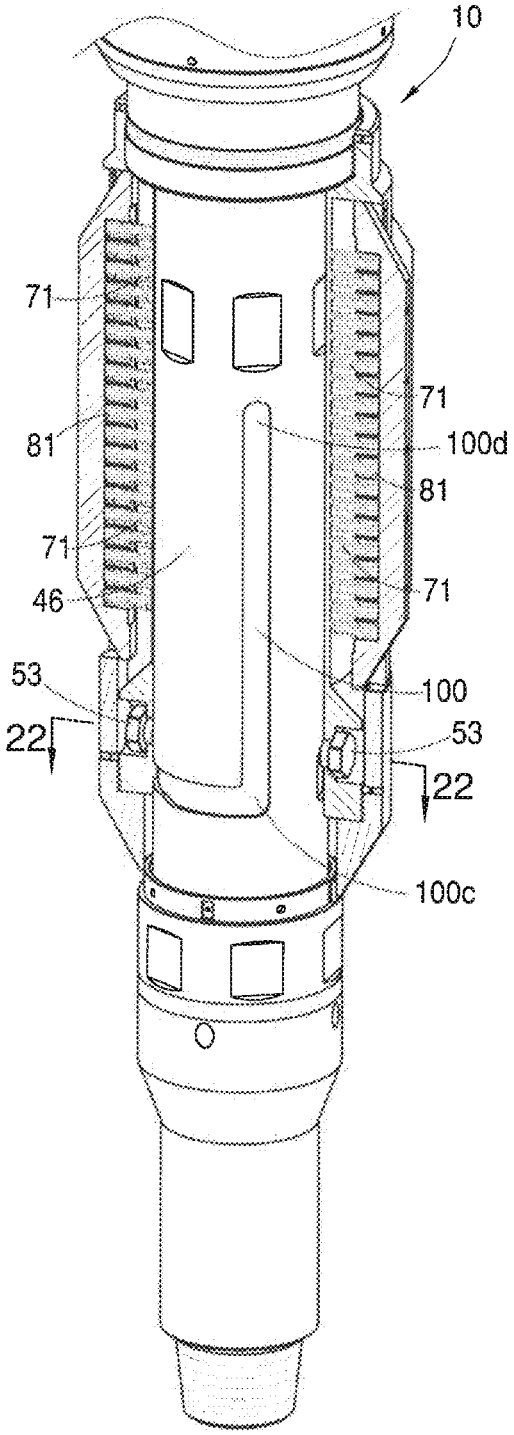

FIG. 19 depicts a side perspective and partial cut-away view of a lower portion and J-slot of the retrievable modular packer/bridge plug apparatus of the present invention in a run-in-hole configuration.

Figure 20:
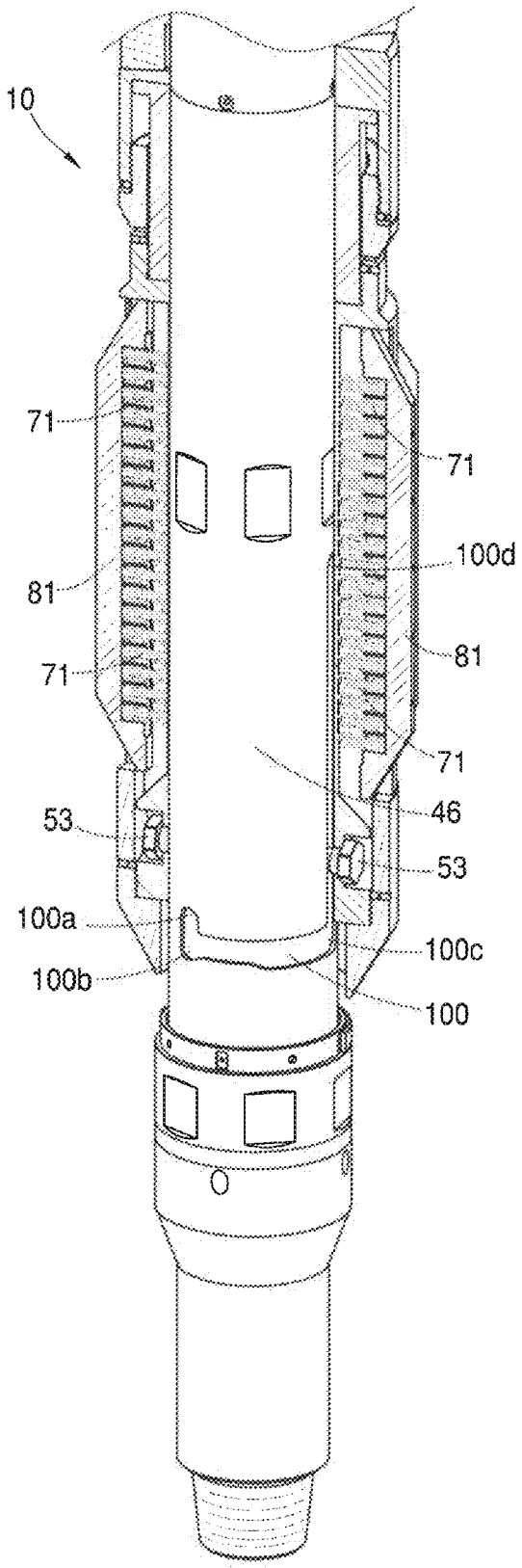

FIG. 20 depicts a side perspective and partial cut-away view of a lower portion and J-slot of the retrievable modular packer/bridge plug apparatus of the present invention in the process of lower slips being set.

Figure 21:
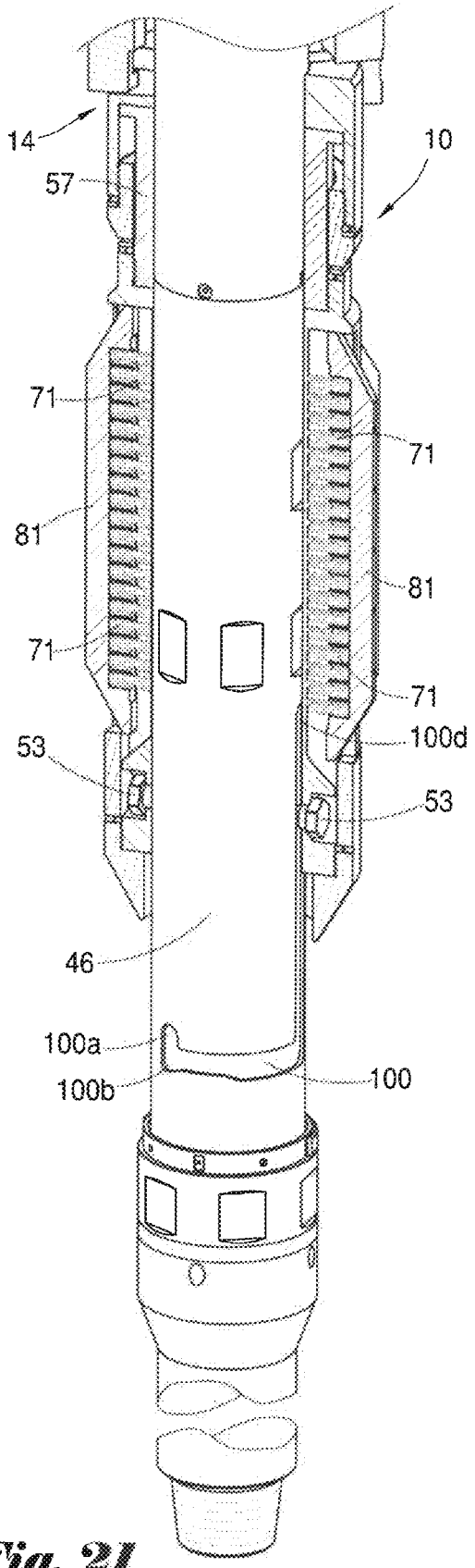

FIG. 21 depicts a side perspective and partial cut-away view of a lower portion and J-slot of the retrievable modular packer/bridge plug apparatus of the present invention with said lower slips set.

Figure 22:
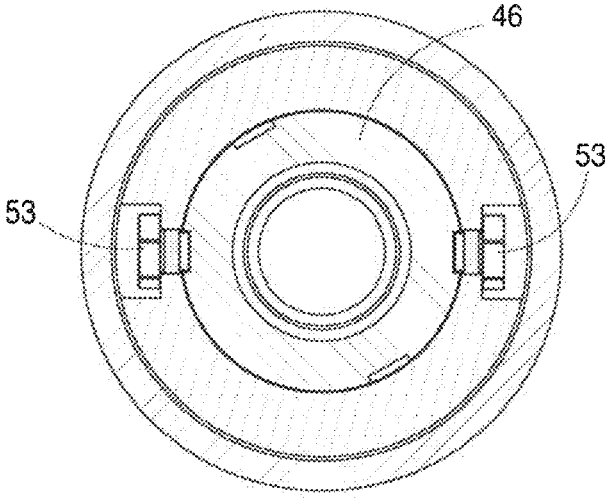

FIG. 22 depicts a sectional view of the retrievable modular packer/bridge plug apparatus of the present invention along line 22-22 of FIG. 19.

Figure 9A:
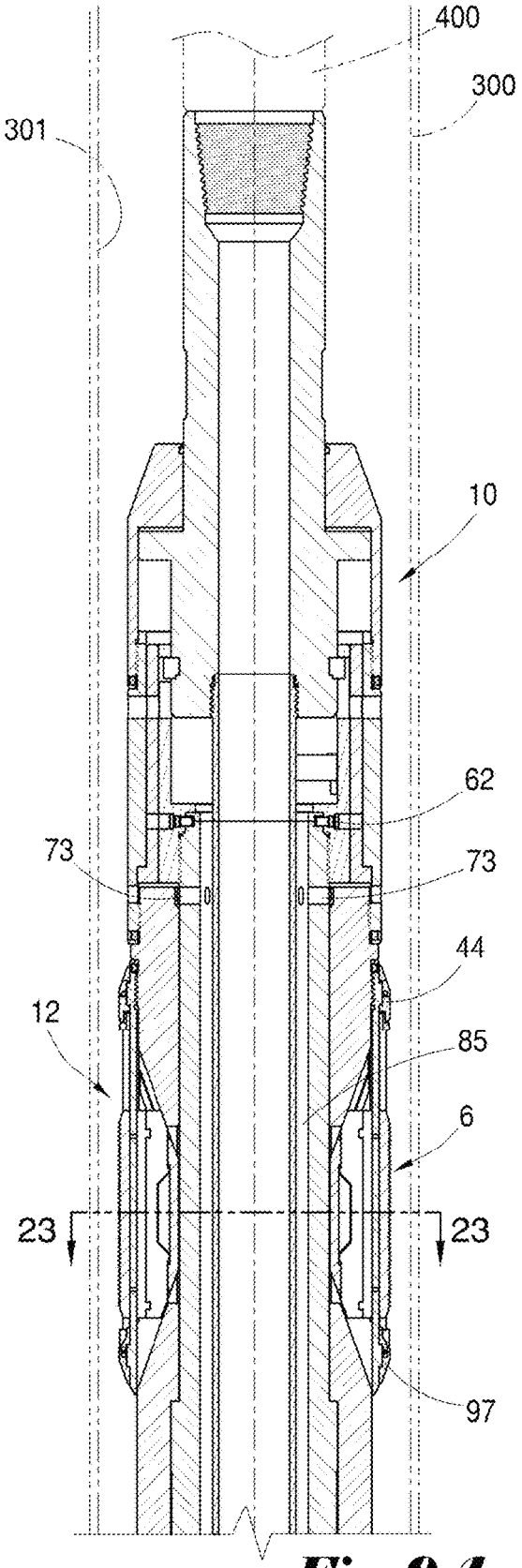
FIGS. 9A through 9C depict a side sectional view of the retrievable modular packer/bridge plug apparatus of the present invention along line 9-9 of FIG. 2 in a run-in-hole configuration.
Figure 23:
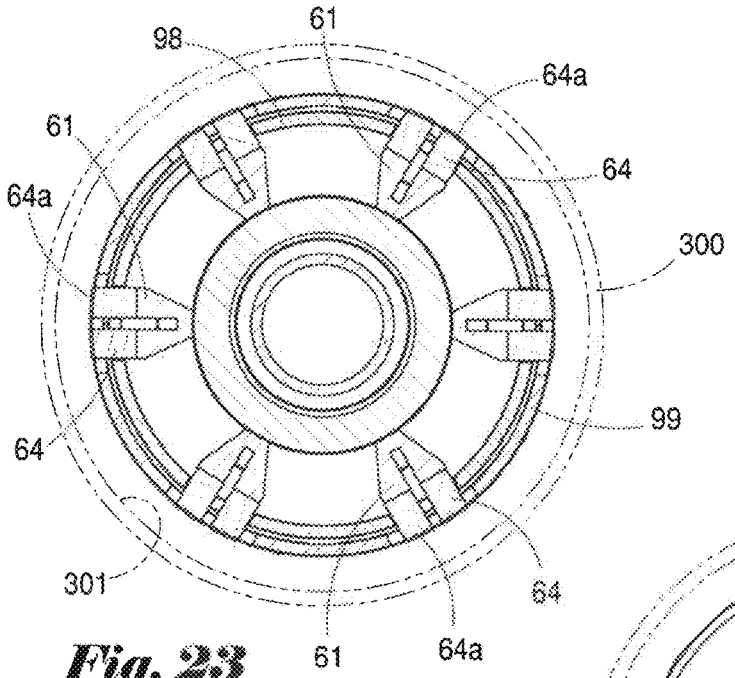

FIG. 23 depicts a sectional view of the retrievable modular packer/bridge plug apparatus of the present invention along line 23-23 of FIG. 9A.

Figure 9B:
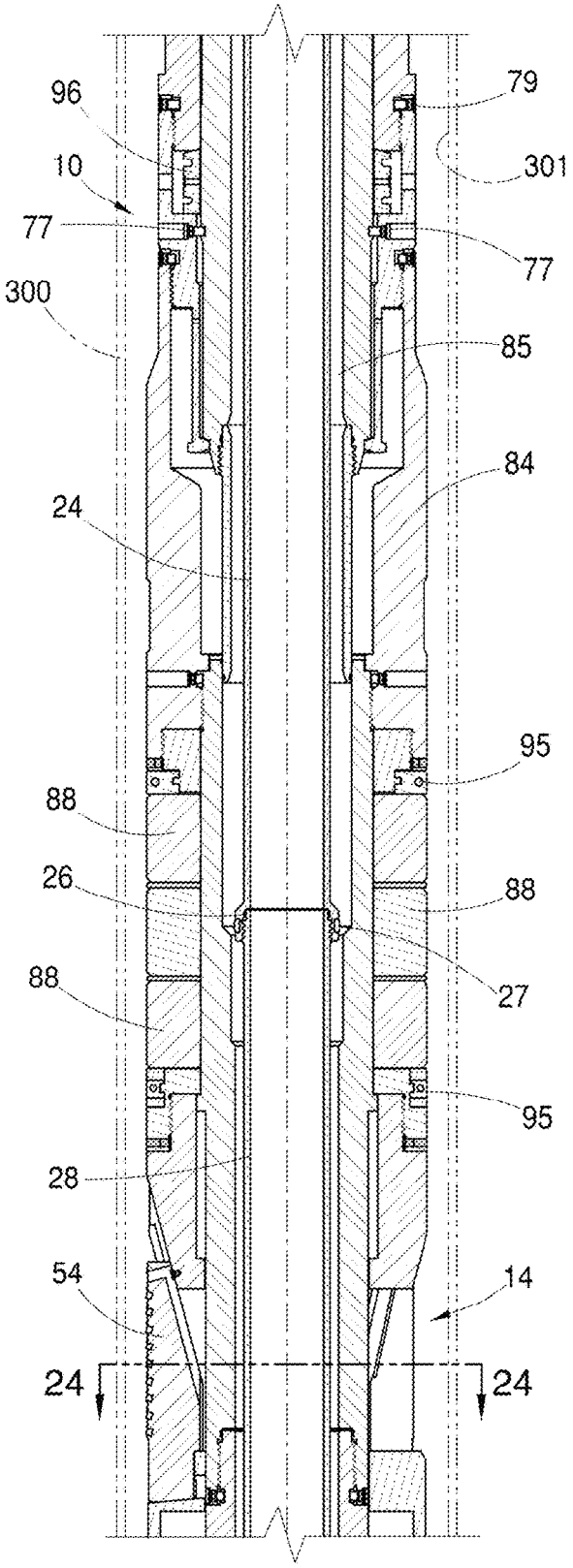
Figure 24:
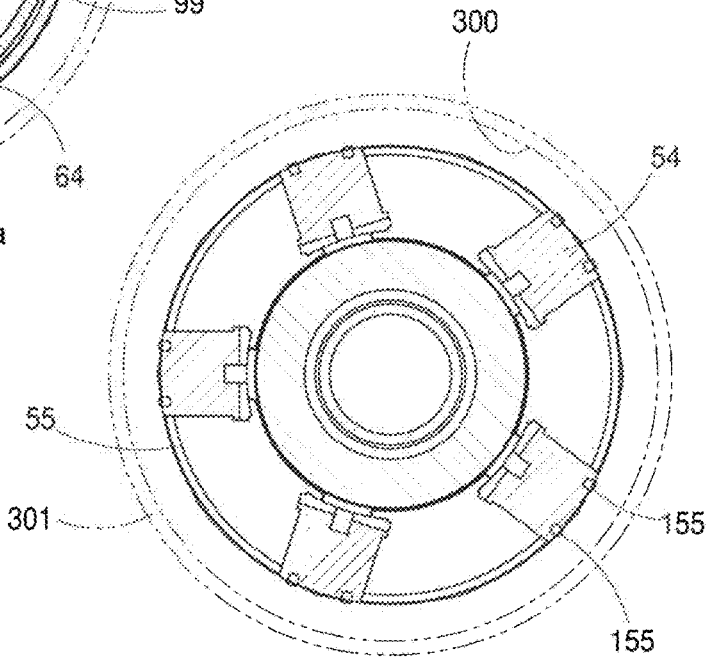

FIG. 24 depicts a sectional view of the retrievable modular packer/bridge plug apparatus of the present invention along line 24-24 of FIG. 9B.

Figure 9C:
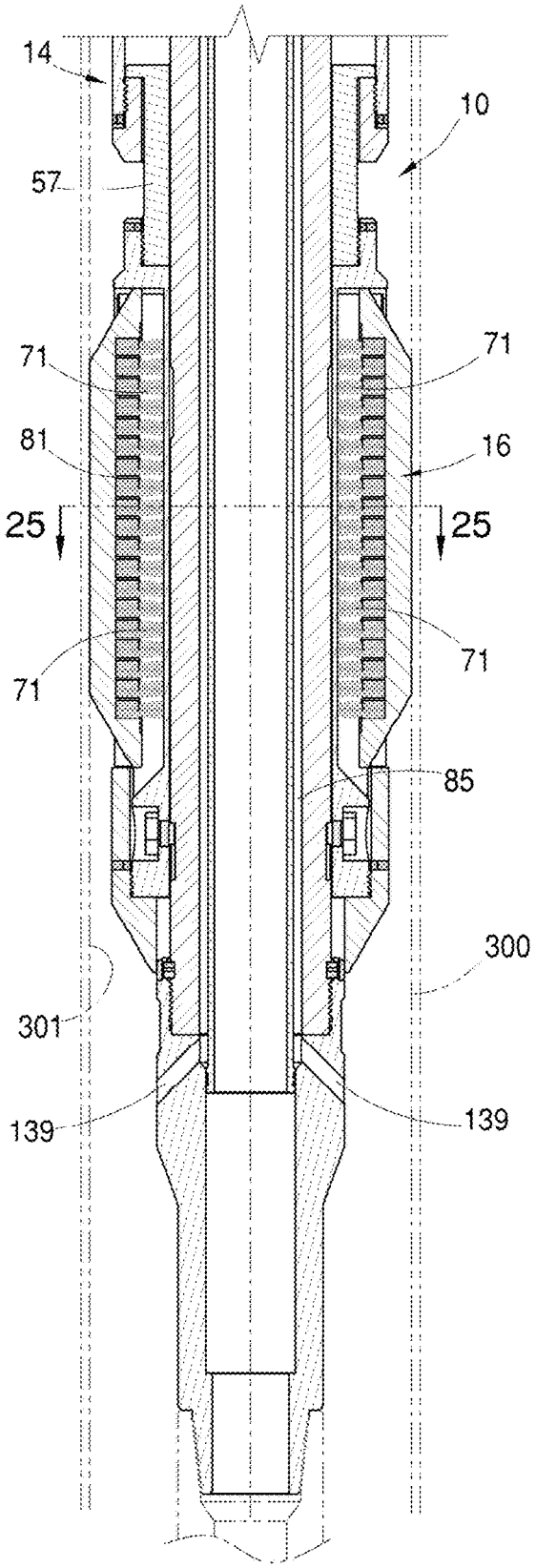
Figure 25:
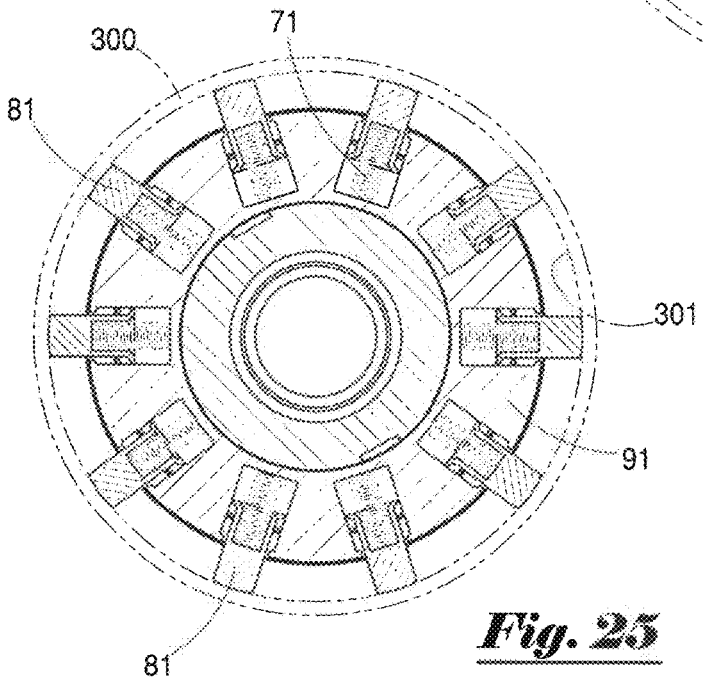

FIG. 25 depicts a sectional view of the retrievable modular packer/bridge plug apparatus of the present invention along line 25-25 of FIG. 9C.

Figure 10A:
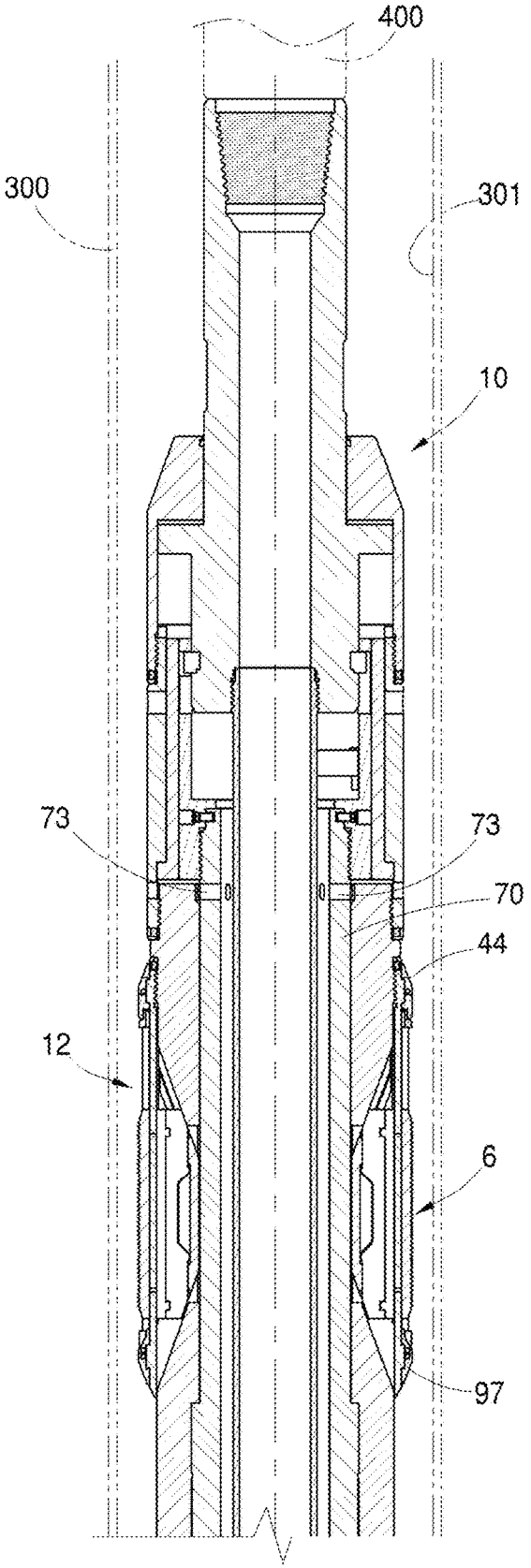
FIG. 10A through 10C depict a side sectional view of the retrievable modular packer/bridge plug apparatus of the present invention in a lower tool unlock configuration.
Figure 10B:
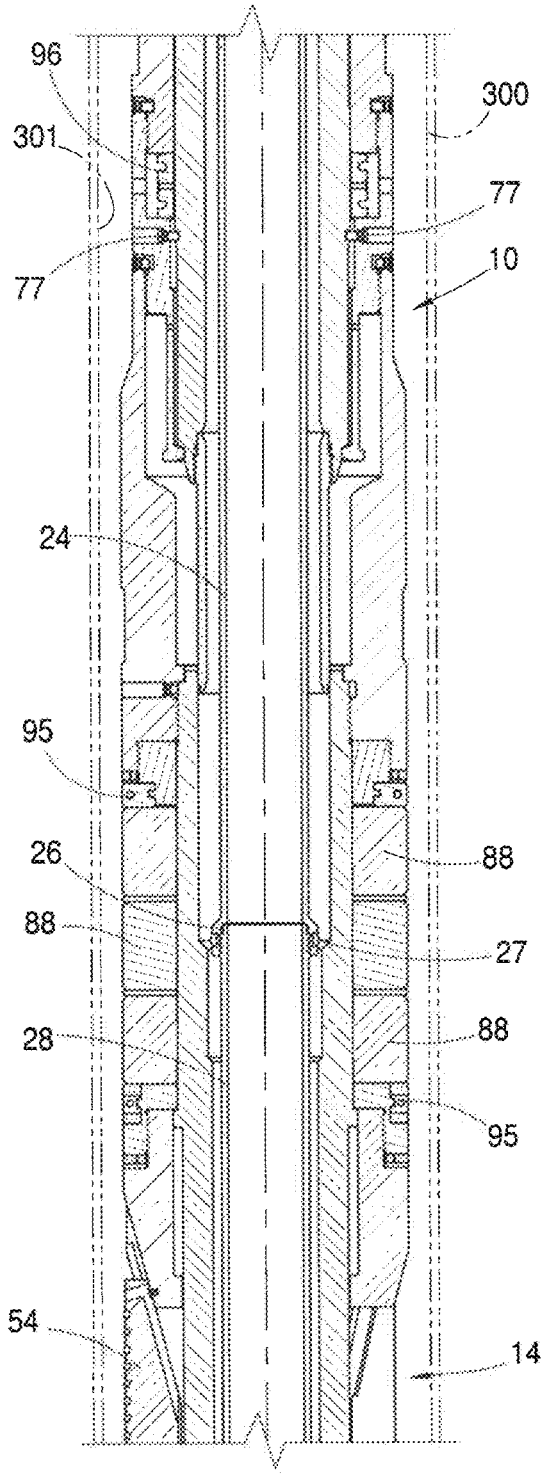
Figure 10C:
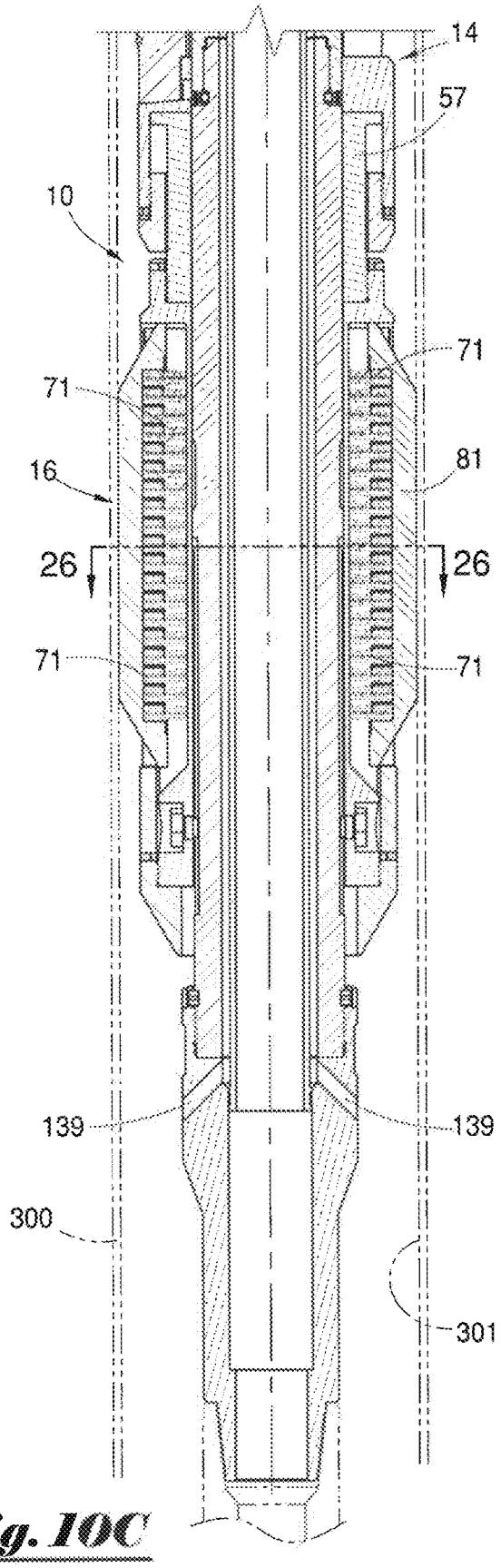
Figure 26:
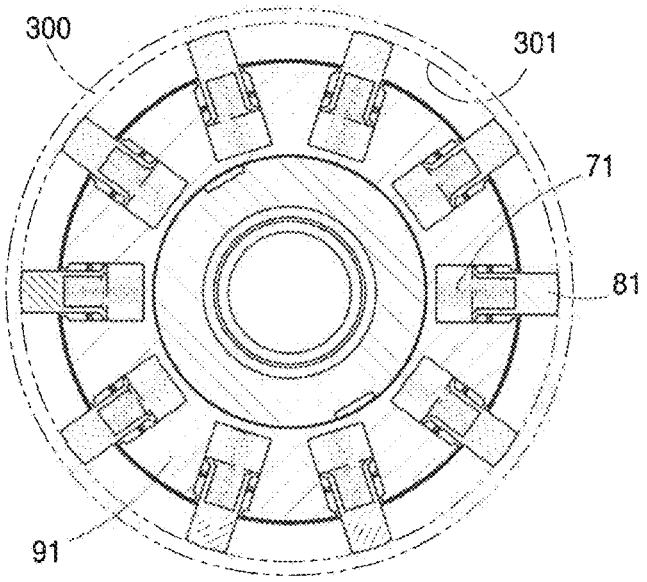

FIG. 26 depicts a sectional view of the retrievable modular packer/bridge plug apparatus of the present invention along line 26-26 of FIG. 10C.

Figure 11A:
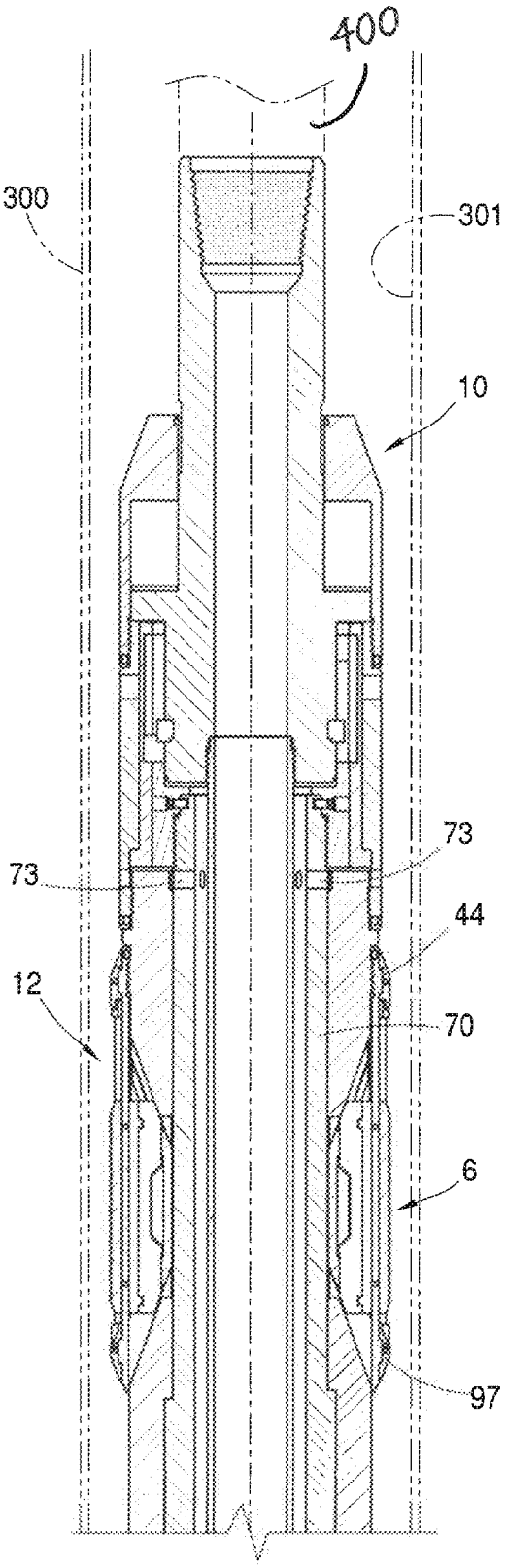
FIG. 11A through 11C depict a side sectional view of the retrievable modular packer/bridge plug apparatus of the present invention in a lower tool set configuration.
Figure 11B:
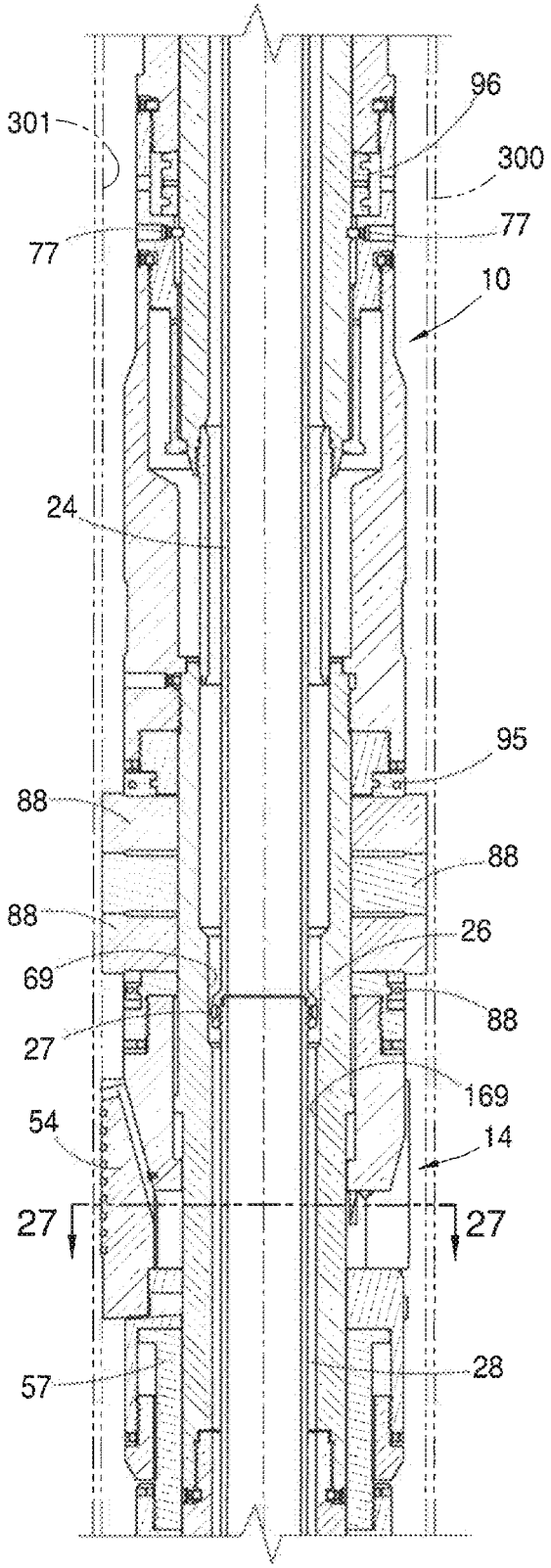
Figure 27:
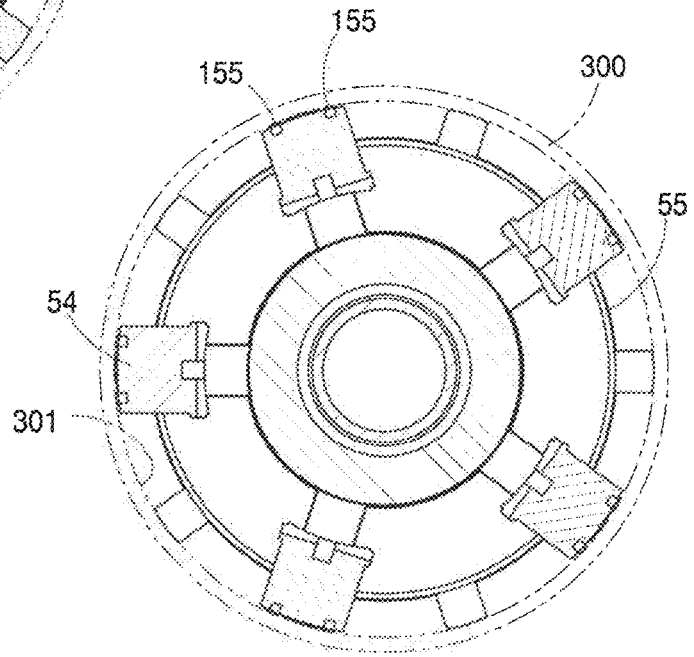

FIG. 27 depicts a sectional view of the retrievable modular packer/bridge plug apparatus of the present invention along line 27-27 of FIG. 11B.

Figure 13A:
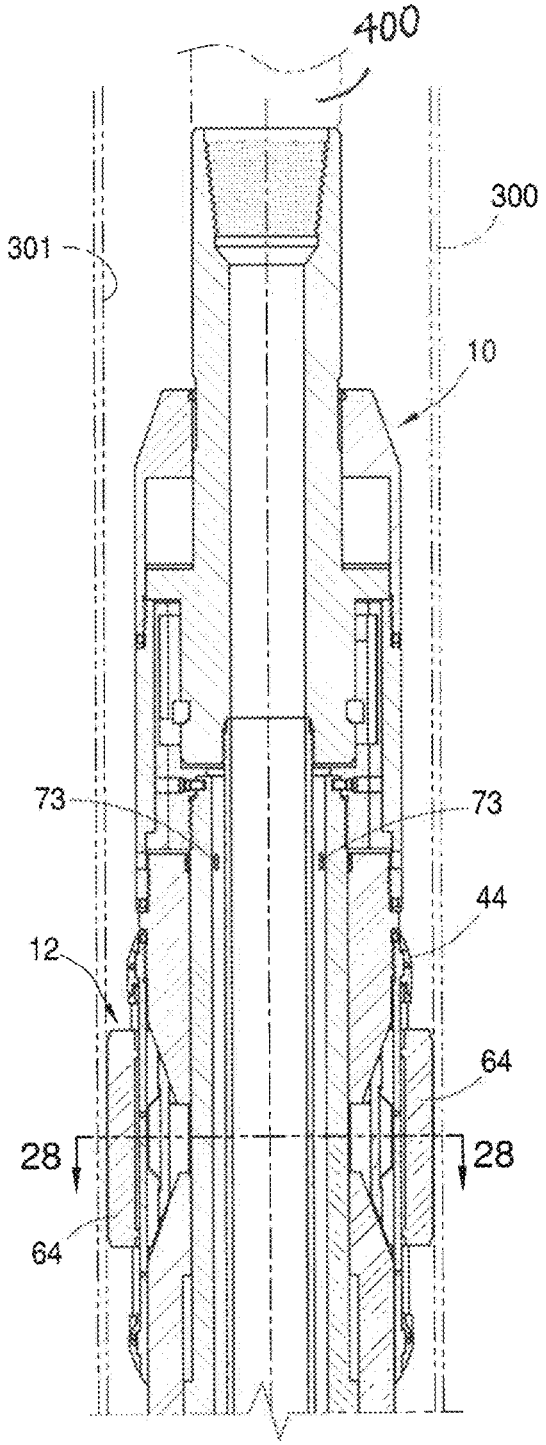
FIG. 13A through 13C depict a side sectional view of the retrievable modular packer/bridge plug apparatus of the present invention in an upper tool set configuration.
Figure 28:
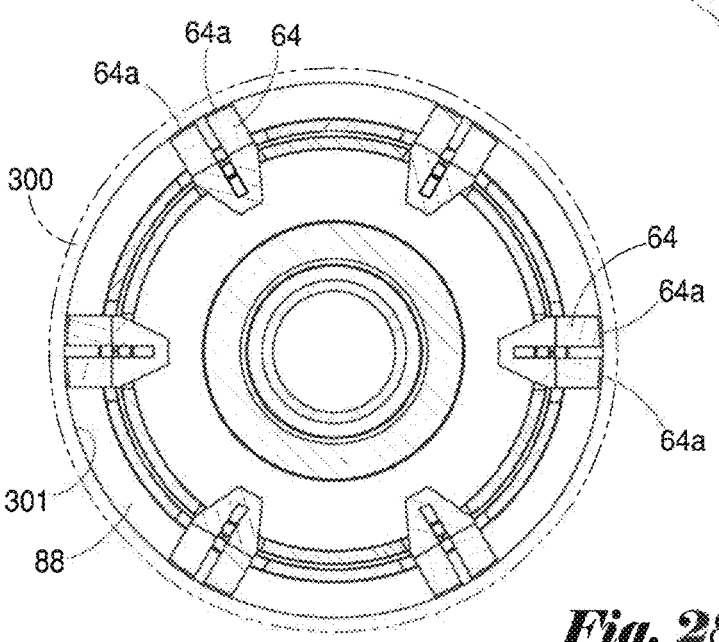

FIG. 28 depicts a sectional view of the retrievable modular packer/bridge plug apparatus of the present invention along line 28-28 of FIG. 13A.

DETAILED DESCRIPTION OF A PREFERRED EMBODIMENT OF THE INVENTION

Before describing various embodiments of the present disclosure in further detail by way of exemplary description, examples, and results, it is to be understood that the apparatus and methods of the present disclosure are not limited in application to the details of specific embodiments and examples as set forth in the following description. The description provided herein is intended for purposes of illustration only and is not intended to be construed in a limiting sense. As such, the language used herein is intended to be given the broadest possible scope and meaning, and the embodiments and examples are meant to be exemplary, not exhaustive. Also, it is to be understood that the phraseology and terminology employed herein is for the purpose of description only and should not be regarded as limiting unless otherwise indicated as so. Moreover, in the following detailed description, numerous specific details are set forth in order to provide a more thorough understanding of the present disclosure.

It will be apparent to a person having ordinary skill in the art that the present disclosure may be practiced without these specific details. In other instances, features which are well known to persons of ordinary skill in the art have not been described in detail to avoid unnecessary complication of the description. It is intended that all alternatives, substitutions, modifications, and equivalents apparent to those having ordinary skill in the art are included within the scope of the present disclosure. Thus, while the apparatus and methods of the present disclosure have been described in terms of particular embodiments, it will be apparent to those of skill in the art that variations may be applied to the apparatus and methods and the steps or in the sequence of steps of the methods described herein without departing from the concept, spirit, and scope of the inventive concepts. Referring to the drawings, like numerals indicate like or corresponding parts throughout the several views.

Figure 1:
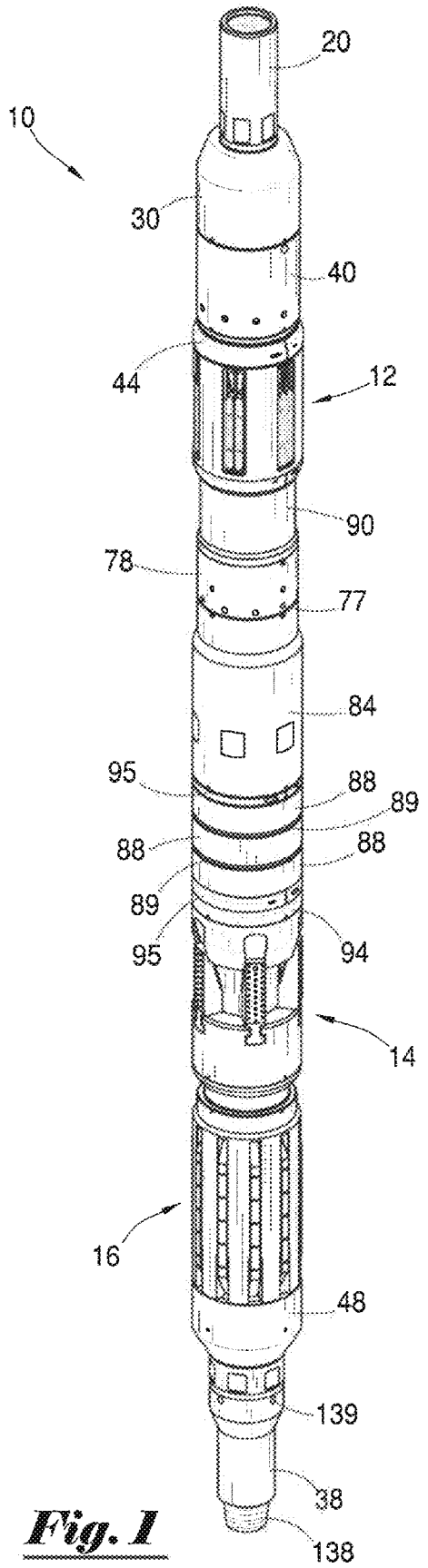
FIG. 1 depicts a side perspective view of the retrievable modular packer/bridge plug apparatus of the present invention.
Figure 2:
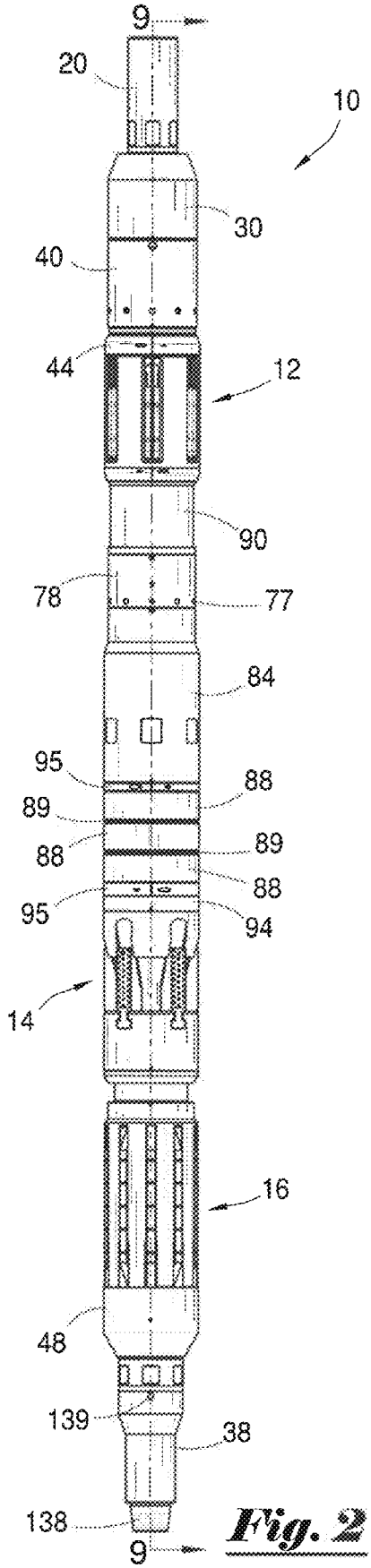
FIG. 2 depicts a side view of the retrievable modular packer/bridge plug apparatus of the present invention.

FIG. 1 depicts a side perspective view of the retrievable modular packer/bridge plug apparatus 10 of the present invention, while FIG. 2 depicts a side view of said retrievable modular packer/bridge plug apparatus 10. Said modular packer/bridge plug apparatus 10 comprises a combination retrievable packer and retrievable bridge plug, fully deployable as a combined assembly, while sub-assemblies thereof providing different functionalities are capable of being independently and selectively operated. Among other benefits, the combined modular packer/bridge plug apparatus 10 eliminates the need for maintaining additional equipment on a drilling rig or other work location, and particularly "standby" or unused equipment.

Referring to FIGS. 1 and 2, retrievable modular packer/bridge plug apparatus 10 generally comprises a top sub 20, sleeve load sub 30, Z-slot housing 40, removable gauge rings 44 and upper slip assembly 12. Below said upper slip assembly 12 is lower cone 90, sleeve cone 78 having a plurality of shear pins 77, bypass housing 84, upper gauge ring 95, a plurality of rubber or elastomeric packer elements 88 and spacer rubber(s) 89, and lower gauge rings 95 and gauge ring body member 94. Below said lower gauge ring 94 is elongated lower slip assembly 14, drag assembly 16, lower sleeve 48 and lower sub 38 having lower fluid ports 139 threaded connection 138.

Figure 3:
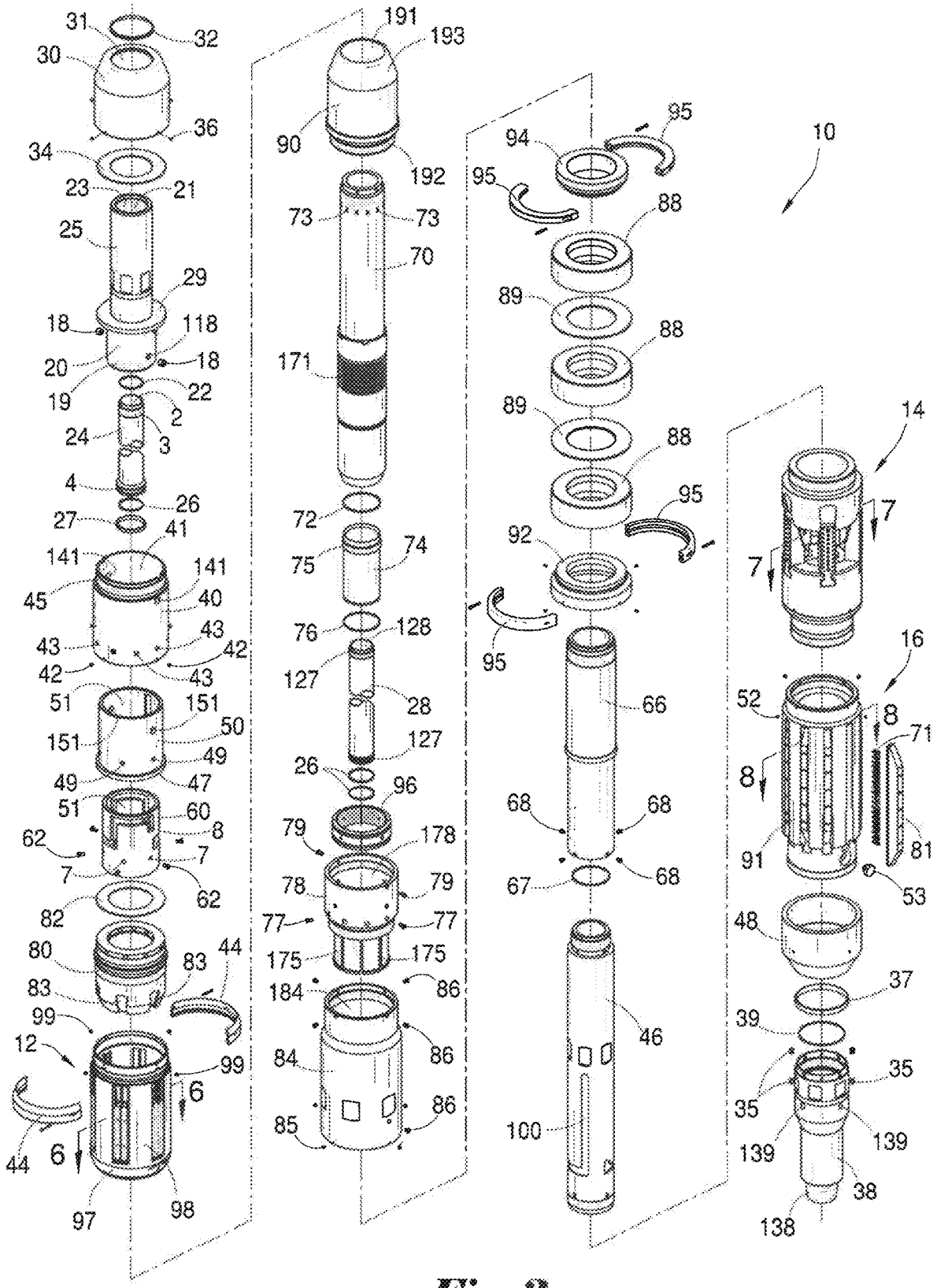
FIG. 3 depicts a side perspective and exploded view of the modular packer/bridge plug apparatus of the present invention.

FIG. 3 depicts a side perspective and exploded view of the retrievable modular packer/bridge plug apparatus 10 of the present invention. Although other configurations can be envisioned without departing from the scope of the present invention, the configuration and relative positioning of components depicted in FIG. 3 represents a preferred embodiment.

Still referring to FIG. 3, retrievable modular packer/bridge plug apparatus 10 of the present invention includes top sub 20. In a preferred embodiment, said top sub 20 comprises substantially cylindrical member having central through bore 21 that extends through said top sub 20. Threads 23 are disposed on the inner surface of said central through bore 21; said threads 23 can form a female or box-end threaded connection that is configured to mate with an opposing male pin-end threaded connection such as, for example, from a tubular work string (not shown) in FIG. 3. Top sub 20 further comprises elongated body section 25, external flange ring 29 and external threads 19.

Wear bushing 34 can be received on elongated body section 25 of top sub member 20; however, said wear bushing 34 does not extend past external flange ring 29. Sleeve load sub 30 has central through bore 31 and is also received on elongated body section 25 of top sub member 20. Rod wiper member 32 is disposed between said sleeve load sub 30 and elongated body section 25 of top sub member 20. Sleeve load sub 30 can be held in place on elongated body section 25 of top sub member 20 using set screws 36. Z-slot pins 18 can be at least partially received in bores 118 and beneficially protrude radially outward from said top sub member 20.

Although other connection methods and configurations can be envisioned without departing from the scope of the present invention, it is to be observed that retrievable modular packer/bridge plug apparatus 10 of the present invention can be installed at one or more desired location(s) within a tubular work string (such as drill pipe or the like)

that is being conveyed into and out of a wellbore. Further, said retrievable modular packer/bridge plug apparatus 10 can be threadedly connected to said tubular work string positioned above and/or below said retrievable modular packer/bridge plug apparatus 10; although other cross-over subs and/or tools may also be employed, work string or other components can be operationally attached to retrievable modular packer/bridge plug apparatus 10 using upper threaded connection 23 or lower threaded connection 138.

Upper bypass sleeve 24 is substantially tubular and has central through bore 2 extending through said upper bypass sleeve 24, as well as rubber or elastomeric O-ring 22. Upper external threads 3 are disposed on said upper bypass sleeve 24 near one end of said upper bypass sleeve 24, while lower external seal profile 4 is disposed near the opposite end of said upper bypass sleeve 24. Bonded seal member 27 is disposed in said lower external seal profile 4 of said upper bypass sleeve 24, while rubber or elastomeric O-ring (with backup) 26 is provided.

Substantially cylindrical Z-slot housing 40 has central through bore 41. A plurality of circumferentially-spaced apart transverse bores 43, as well as transverse flow bores 141, extend through said Z-slot housing 40. External threads 45 are disposed on the external surface of said Z-slot housing 40, and are configured to engage with mating connection threads (not visible in FIG. 3) disposed on the inner surface of through bore 31 of sleeve load sub 30. A plurality of set screws 42 can be received within said transverse bores 43.

Substantially cylindrical outer control sleeve 50 has central through bore 51 and is at least partially disposed within central through bore 41 of Z-slot housing 40. A plurality of circumferentially-spaced apart transverse bores 49, as well as transverse flow bores 151, extend through said cylindrical outer control sleeve 50. Outer flange ring 47 extends around the outer surface of said outer control sleeve 50. Said outer control sleeve 50 is configured to be at least partially received within central through bore 41 of Z-slot housing 40.

Substantially cylindrical inner control sleeve 60 has central through bore 51 and is at least partially received within outer control sleeve 50. A plurality of circumferentially-spaced apart transverse bores 7 extend through said cylindrical inner control sleeve 60. Said inner control sleeve 60 is configured to be at least partially received within central through bore 51 of outer control sleeve 50. Z-slot 8 extends through said inner control sleeve 60; Z-slot pins 18 are movably disposed within said Z-slot 8. Lower bushing 82 is provided between inner control sleeve 60 and upper cone member 80.

Figure 4:
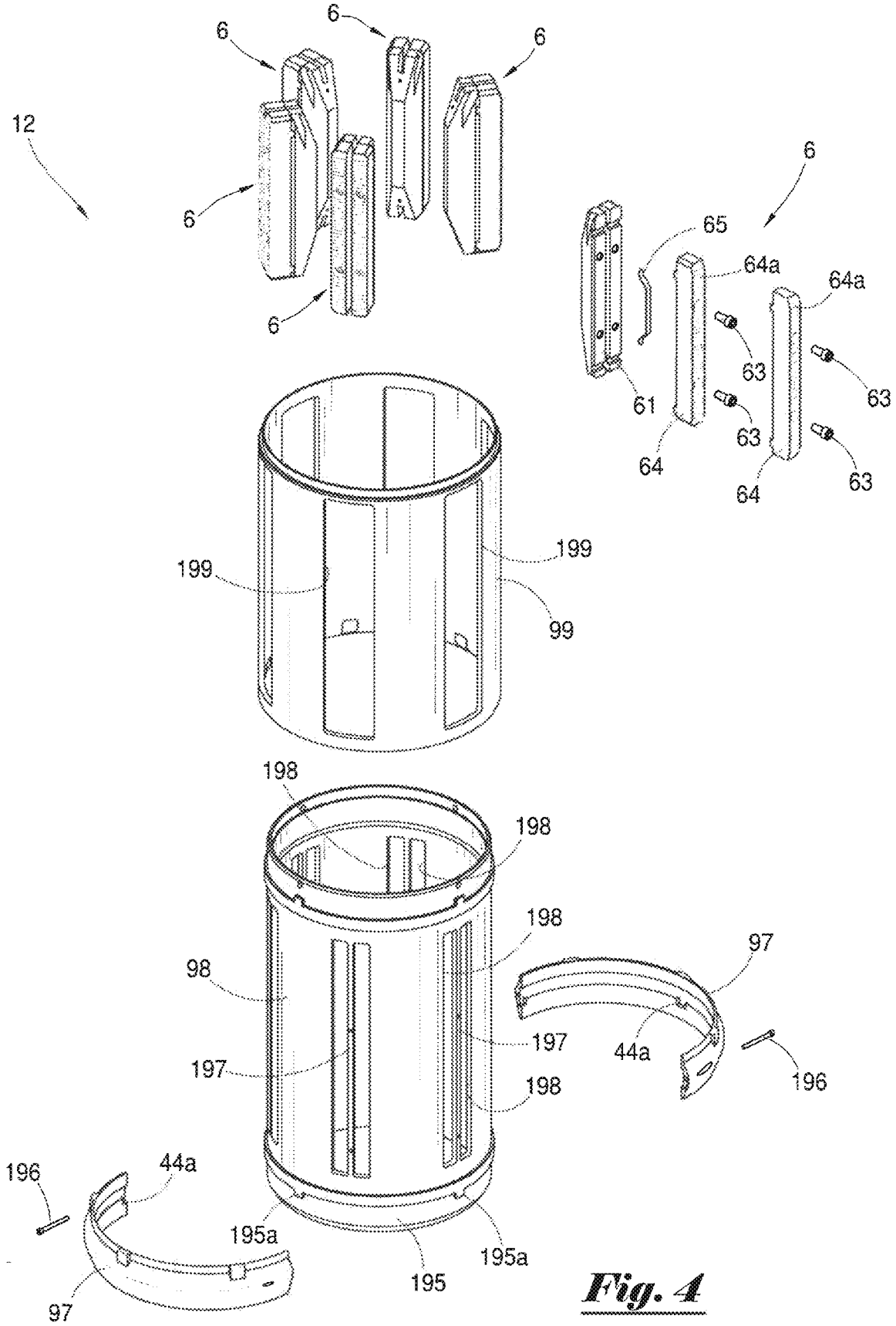
FIG. 4 depicts a side perspective and exploded view of a first (upper) slip assembly of the present invention.

Upper cone member 80 is provided for upper slip assembly 6, which is described in more detail in FIG. 4. Upper cone member 80 has a plurality of tapered surfaces 83 that are circumferentially-spaced apart around the external surface of said upper cone member 80. Removeable gauge ring members 44 are disposed around upper slip cage 98; in a preferred embodiment, said removeable gauge ring members 44 can comprise opposing semi-circular members that, when installed, cooperate to define a desired outer diameter dimension.

Lower cone member 90 is provided for upper slip assembly 6. Said lower cone member 90 has central through bore 191 lower threads 192, as well as tapered shoulder surface 193. Said tapered shoulder surface 183 provides an actuation surface for slips of said upper slip assembly 6 as described in more detail herein. Upper mandrel 70 is at least partially received within said central through bore 191 of lower cone member 90. External threads 171 are disposed on the outer surface of said upper mandrel 70, while at least one upper port 73 extend transversely through said upper mandrel 70.

Middle bypass member 74, having O-rings (with back up) 72 and 76, is disposed below said upper mandrel 70. External threads 75 are disposed on said middle bypass member 74. Lower bypass sleeve 28 is substantially cylindrical having central through bore 128, as well as upper external threads 127 and lower external threads 128. Lock ring segment 96 has internal threads and is connected to external threads 171 of upper mandrel 70. Sleeve cone 78 having central through bore 178 and collet fingers 175 is threadedly connected to cone 90. Sleeve cone pins 79 are received in bores in said sleeve cone 78, as well as lock ring segment 96. Bypass housing 84 has central through bore 184 and bypass housing pins 86, and is threadedly connected to sleeve cone 78. At least one shear pin 77 are disposed in transverse bores extending into said sleeve cone 78. The amount of force required to shear said at least one shear pin 77 can be selectively set to a desired shear force value by adding or subtracting the number of said shear pins 77 installed in said sleeve cone 78, as well as the shear-force rating thereof. Further, said shear force is field configurable and can be selectively set and/or adjusted in virtually any location including, without limitation, on a drilling rig.

Removeable gauge ring members 95 are disposed around upper gauge body member 94. Similarly, removeable gauge ring members 95 are also disposed around lower gauge body member 92. In a preferred embodiment, each of said sets of said removeable gauge ring members 95 can comprise opposing semi-circular members that, when installed, cooperate to define a desired outer diameter dimension. A plurality of stacked rubber or elastomeric packer elements 88 and spacer rubber(s) 89 are disposed between said gauge rings. Lower mandrel 46 having J-slot 100 is attached to central mandrel 66.

Lower (long) slip assembly 14 and drag assembly 16 are disposed below said lower gauge rings 95. Drag assembly 16 has a plurality of non-marking drag blocks 81, which are biased radially outward relative to drag housing 91 by bias springs 71, and drag housing lug 53. Said non-marking drag blocks 81 do not gouge or damage casing of a surrounding wellbore. Lower sleeve 48, lower sub key cover 37 and lower sub 38 (having lower threaded connection 138 and fluid ports 139) are disposed below said drag assembly 16.

FIG. 4 depicts a side perspective and exploded view of upper slip assembly 12 of the present invention. In a preferred embodiment, said upper slip assembly 12 comprises slip cage 98. Said slip cage 98 is substantially cylindrical, defining a plurality of elongated slots 198 that are oriented substantially parallel to the longitudinal axis of said slip cage 98. Further, said elongated slots 198 are arranged in pairs, in parallel and spaced relationship, around the circumference of substantially cylindrical slip cage 98, with each pair of slots separated by divider member 197.

A plurality of slip assemblies 6 are operationally mounted to upper slip cage 98. Each slip assembly 6 generally comprises a plurality of slip dies 64 oriented parallel to each other and attached to a slip segment 61 using mechanical fasteners 63. Said slip dies 64 can have raised or textured outer surfaces **64*a* to enhance frictional gripping force when said slips 64 are extended radially outward to engage against and grip against a surrounding wellbore surface. Slip springs 65 are disposed between said slip dies 64 and slip cage 98 (and, more specifically, divider members 197) in order to bias said slip dies 64 radially inward. Said slip assemblies 6 are operationally mounted to said upper slip cage 98 so that substantially parallel slip dies 64 are aligned with and can selectively extend through said elongated slots 198 of said upper slip cage 98. Slip housing 99 is substantially cylindrical, defining a plurality of elongated slots 199 oriented substantially parallel to the longitudinal axis of said slip housing 99; slip housing 99 is received over upper slip cage 98, with said elongated slots 199 aligned with slip assemblies 6**.

Upper slip cage 98 defines external shoulder ring 195 having a plurality of spaced-apart notches 195*a* disposed in spaced relationship around its outer circumference. Removeable gauge ring members 97 are disposed on said external shoulder ring 195 around upper slip cage 98 and secured in place using mechanical fasteners 196. Said removeable gauge ring members 97 can comprise opposing semi-circular members that, when installed, cooperate to define a desired outer diameter dimension. Tabs 44*a* disposed on the inner surface of said gauge ring members 97 can be received within spaced-apart notches 195*a* of external shoulder ring 95 to prevent said gauge ring members 97 from undesired rotation around external shoulder ring 195.

Figure 5:
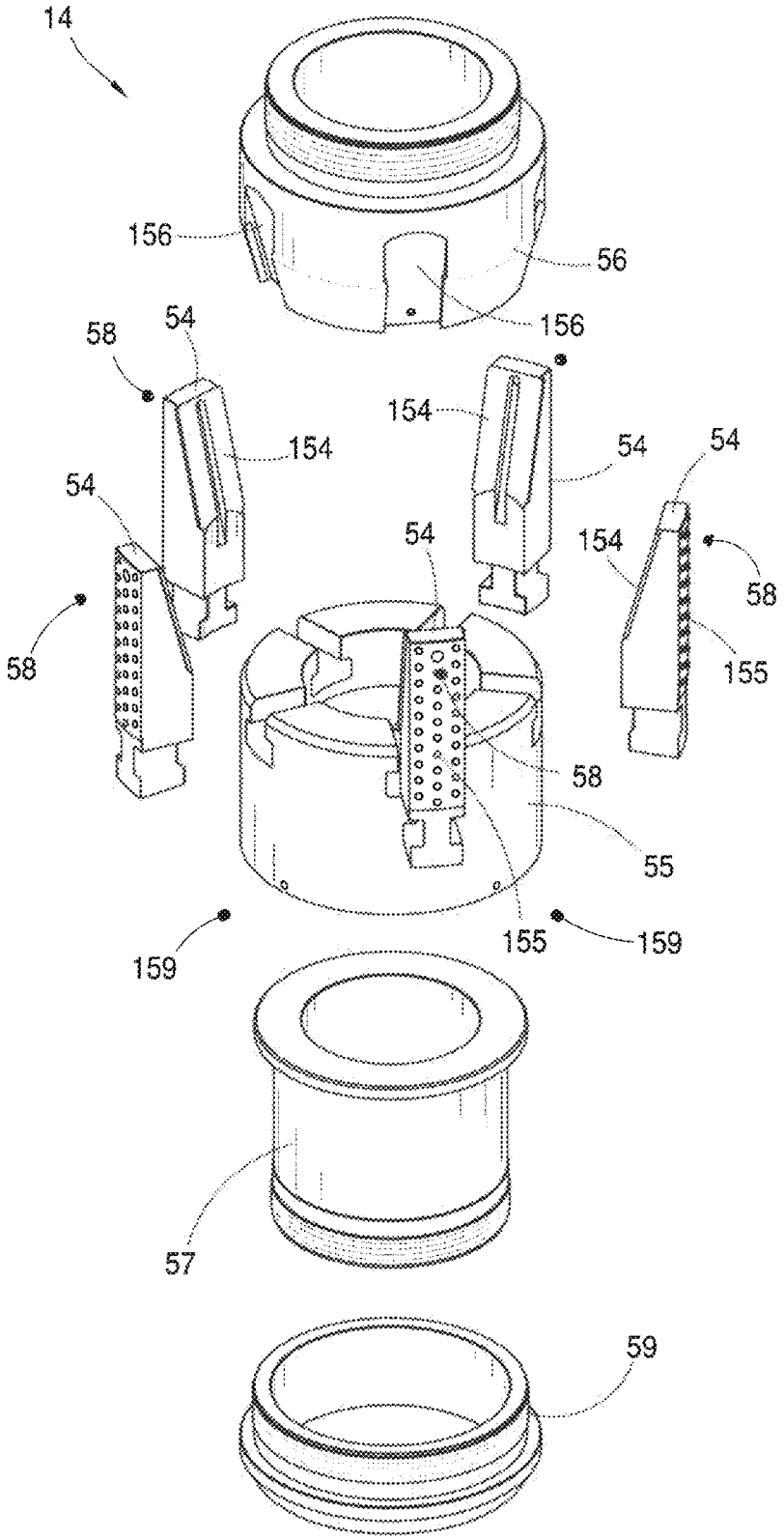
FIG. 5 depicts a side perspective and exploded view of a second (lower) slip assembly of the present invention.

FIG. 5 depicts a side perspective and exploded view of a long lower slip assembly 14 of the present invention. In a preferred embodiment, said lower slip assembly 14 generally comprises a plurality of slip segments 54 having tapered back surfaces 154. Said slip segments 54 are movably attached to lower slip cage 55. Said tapered back surfaces 154 of slip segments 54 are aligned with and engage against tapered surfaces 156 of slip cone 56. Cap screws 58 can secure said slips 54 against movement relative to slip cone 56 until and unless a predetermined force acts upon said slips 54. Further, said slips 54 can have buttons 155 or other raised or textured profiles to enhance frictional gripping force when said slips 54 are extended radially outward to engage against and grip against a surrounding wellbore surface. Slip cage swivel 57 is partially received within slip cage 55, while retainer ring 59 is secured to slip cage 55 using set screws 159.

Figure 6:
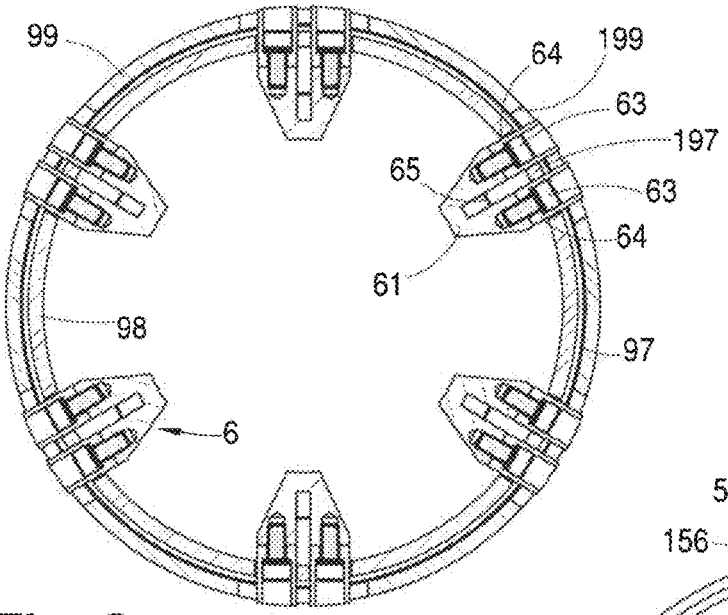
FIG. 6 depicts a sectional view along line 6-6 of FIG. 3.

FIG. 6 depicts a sectional view of slip assembly 12 along line 6-6 of FIG. 3. Slip cage 98 is substantially cylindrical. A plurality of slip assemblies 6 are disposed around the circumference of slip cage 98 in spaced relationship. Each slip assembly 6 comprises a plurality of slip dies 64 oriented parallel to each other and attached to a slip segment 61 using mechanical fasteners 63. Slip springs 65 are disposed between said slip dies 64 and divider members 197 of slip cage 98 in order to bias said slip dies 64 radially inward relative to slip cage 98. Slip housing 99 is substantially cylindrical, defining a plurality of elongated slots 199; slip housing 99 is received over slip cage 98, with said elongated slots 199 aligned with slip assemblies 6. Removeable gauge ring members 97 can comprise opposing semi-circular members that, when joined, cooperate to define a desired outer diameter dimension.

Figure 7:
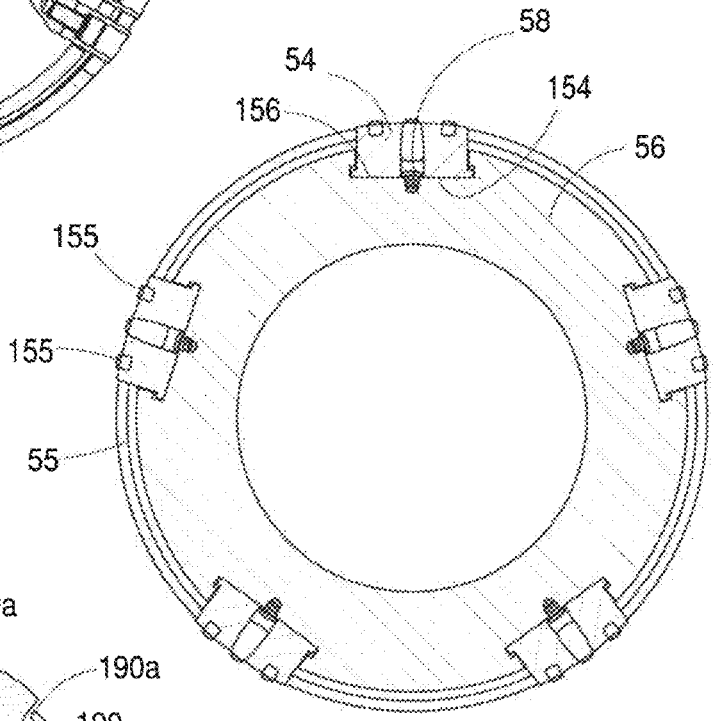
FIG. 7 depicts a sectional view along line 7-7 of FIG. 3.

FIG. 7 depicts a sectional view of lower slip assembly 14 along line 7-7 of FIG. 3. A plurality of slip segments 54 are movably attached to slip cage 55. Said slip segments 54 have tapered back surfaces 154 that are aligned with and engage against tapered surfaces 156 of slip cone 56. Cap screws 58 can secure said slips 54 against movement relative to slip cone 56; said cap screws 58 can release when a predetermined force acts upon said slips 54, thereby allowing said slips 54 to move relative to slip cone 56. When said slips 54 move relative to slip cone 56, tapered back surfaces 154 engage against and ride along tapered surfaces 156 of slip cone 56, thereby causing said slips 54 to extend radially outward relative to slip cone 56. Further, said slips 54 can have buttons 155 or other raised or textured profiles in order to enhance frictional gripping force when said slips 54 are extended radially outward to engage against and grip against a surrounding wellbore surface.

Figure 8:
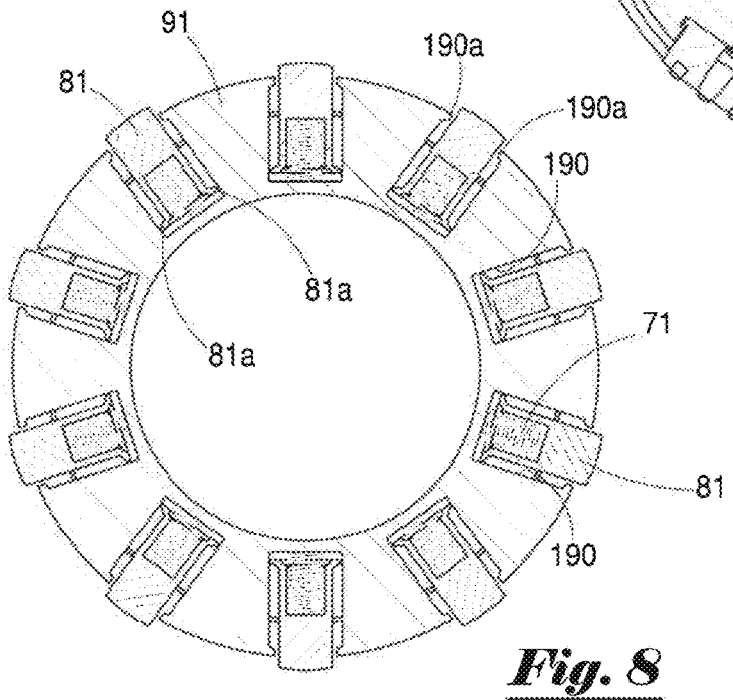
FIG. 8 depicts a sectional view along line 8-8 of FIG. 3.

FIG. 8 depicts a sectional view of drag block assembly 16 along line 8-8 of FIG. 3. Drag housing 91 forms a substantially cylindrical housing having a plurality of elongated recesses 190 having end protrusions 190*a*; in a preferred embodiment, said spaced-apart elongated recesses 190 are aligned substantially parallel to the longitudinal axis of said drag housing 91, and are disposed around the circumference of said drag housing 91 in spaced relationship. A plurality of drag blocks 81 having protrusions 81*a* are moveably disposed in said recesses 190 and are biased radially outward relative to drag housing 91 by bias springs 71. Said protrusions 81*a* of said drag blocks 81 and end protrusions 190*a* of elongated recesses 190 cooperate to limit travel of said drag blocks 81 in a radially outward direction and retain said drag blocks 81 within said elongated recesses 190.

FIGS. 9A through 9C depict a side sectional view of the retrievable modular packer/bridge plug apparatus 10 of the present invention along line 9-9 of FIG. 2 in a run-in-hole configuration. Said retrievable modular packer/bridge plug apparatus 10 of the present invention can be conveyed into a wellbore, and manipulated therein, utilizing a tubular work string 400. In this configuration, the robust internal fluid bypass (flow path) 85 of the retrievable modular packer/bridge plug apparatus 10 is fully open to fluid flow. Further, slip assemblies 6 of upper slip assembly 12 and slips 54 of lower slip assembly 14 are fully retracted. Similarly, rubber or elastomeric packer elements 88 are not compressed and energized; as such, said packer elements 88 are not expanded radially outward. Drag blocks 81 of drag assembly 16 are biased radially outward by springs 71 to contact and engage against inner surface 301 of surrounding casing string 300. Shear pins 77 are not sheared.

In the configuration depicted in FIGS. 9A through 9C, none of said components (slip assemblies 6, slips 54, or packer elements 88—or any other components of retrievable modular packer/bridge plug apparatus 10 except for drag blocks 81) extend radially outward beyond the predetermined outer diameter(s) of gauge rings 44, gauge rings 97 and gauge rings 95. Further, none of said components except drag blocks 81 contact inner surface 301 of a surrounding casing string 300.

FIG. 23 depicts a sectional view of the retrievable modular packer/bridge plug apparatus 10 of the present invention along line 23-23 of FIG. 9A. A plurality of slip dies 64 are disposed around the circumference of slip cage 98 in spaced relationship. In this configuration, it is to be observed that raised or textured outer surfaces 64*a* of slip dies 64 do not extend radially outward beyond the outer surface of slip housing 99. As a result, said slip dies 64 do not extend radially outward or contact inner surface 301 of a surrounding casing string 300.

FIG. 24 depicts a sectional view of the retrievable modular packer/bridge plug apparatus 10 of the present invention along line 24-24 of FIG. 9B. A plurality of slip segments 54 are movably attached to slip cage 55 in spaced arrangement around the circumference of said slip cage 55. In this configuration, it is to be observed that slips 54 (including, without limitation, slip buttons 55) do not extend radially outward beyond the outer surface of slip cage 55. As a result, said slip segments 54 do not extend radially outward from said slip cage 55 or contact inner surface 301 of a surrounding casing string 300.

FIG. 25 depicts a sectional view of the retrievable modular packer/bridge plug apparatus 10 of the present invention along line 25-25 of FIG. 9C. A plurality of drag blocks 81 are moveably disposed in recesses 190 in drag housing 91. In this configuration, it is to be observed that drag blocks 81 extend radially outward beyond the outer surface of drag housing 91. As a result, said drag blocks 81 can extend radially outward from said drag housing 91 to contact inner surface 301 of a surrounding casing string 300.

Still referring to FIGS. 9A-9C, anti-rotation pins are installed and engaged, and retrievable modular packer/bridge plug apparatus 10 is in tension. In this configuration, the robust internal fluid bypass (flow path) 85 of the retrievable modular packer/bridge plug apparatus 10 is fully open to fluid flow. Fluid can flow through upper flow ports 73, around the exterior of upper bypass sleeve 24 and lower bypass sleeve 28, and seal 27 (which in this position does not form a fluid pressure seal against an opposing bore surface), and through lower flow ports 139. Further, because said internal fluid bypass flow path 85 is open, fluid can flow through retrievable modular packer/bridge plug apparatus 10, reducing surge pressures when running in a well and swab pressures when pulling out of a well, and allowing for quicker fluid displacements and negative testing operations.

FIG. 14 depicts a side perspective and partial cut-away view of an upper portion of the retrievable modular packer/bridge plug apparatus 10 of the present invention including, without limitation, control sleeve 60 having Z-slot 8. Z-slot pin 18 is moveably disposed within said Z-slot 8 It is to be observed that when Z-slot pin 18 is in position 8*b* within Z-slot 8, retrievable modular packer/bridge plug apparatus 10 of the present invention is in the "run-in-hole" configuration depicted in FIGS. 9A through 9C. FIG. 16 depicts a sectional view of the retrievable modular packer/bridge plug apparatus of the present invention along line 16-16 of FIG. 14, wherein Z-slot pin 18 is in position 8*b* in Z-slot 8.

Referring to FIG. 19, in this configuration, drag block lug 53 is in position 100*a* within J-slot 100 (said position 100*a* is best observed in FIGS. 20 and 21), representing a locked "run-in-hole" position for said J-slot 100. FIG. 22 depicts a sectional view of the retrievable modular packer/bridge plug apparatus of the present invention along line 22-22 of FIG. 19.

The weight of a work string 400 used to convey said retrievable modular packer/bridge plug apparatus 10 into a well can be picked up, causing said drag block lug 53 to shift from position 100*a* to position 100*b* within J-slot 100 (said position 100*b* is also best observed in FIGS. 20 and 21), representing an unlocked position for said J-slot 100. When Z-slot pin 18 is in position 8*b* in Z-slot 8 as depicted in FIG. 14, and drag block lug 53 is in position 100*b* within J-slot 100, work string 400 can be rotated to apply torque force to retrievable modular packer/bridge plug apparatus 10.

Said torque force can be applied until Z-slot pin 18 is in position 8*c* in Z-slot 8 as depicted in FIG. 15, and drag block lug 53 is in position 100*c* within J-slot 100. In this position, the weight of said work string 400 can be slacked off, with drag block assembly 16 applying increased frictional force against internal surface of a surrounding wellbore. This causes Z-slot pin 18 to move from position 8*c* toward position 8*d* in Z-slot 8. Additionally, drag block lug 53 moves from position 100*c* toward position 100*d* within J-slot 100, as depicted in FIG. 20.

FIG. 10A through 10C depict a side sectional view of the retrievable modular packer/bridge plug apparatus 10 of the present invention in a lower tool unlock configuration. In this configuration, the internal fluid bypass (flow path) of the retrievable modular packer/bridge plug apparatus 10 remains fully open to fluid flow. Further, slip assemblies 6 of upper slip assembly 12 and slips 54 of lower slip assembly 14 are fully retracted. Similarly, rubber or elastomeric packer elements 88 are not energized and are not expanded radially outward.

In the configuration depicted in FIGS. 10A through 10C, slip assemblies 6, slips 54 and packer elements 88 do not extend radially outward beyond the predetermined outer diameter(s) of gauge rings 44, gauge rings 97 and gauge rings 95. Further, none of said components contact inner surface 301 of a surrounding casing string 300. However, it is to be observed that drag blocks 81 extend radially outward beyond the outer surface of drag housing 91, and said drag blocks 81 contact inner surface 301 of a surrounding casing string 300.

Still referring to FIGS. 10A-10C, the robust internal fluid bypass (flow path) of the retrievable modular packer/bridge plug apparatus 10 is fully open to fluid flow. Fluid can flow through upper flow ports 73, around the exterior of upper bypass sleeve 24 and lower bypass sleeve 28, and seal 27 (which in this position does not form a fluid pressure seal against an opposing bore surface), and through lower flow ports 139. However, as depicted in FIG. 10A-10C, and with reference to J-slot 100 in FIG. 20, said lower slip assembly 14 is in the process of being set.

Thereafter, the weight of said work string 400 can be further "slacked off", causing top sub member 20 to move axially relative to sleeve load sub 30 from position 8*c* to position 8*d* in Z-slot 8 as depicted in FIG. 17; similarly, drag block lug 53 moves position 100*d* within J-slot 100, as depicted in FIG. 21. In this configuration, when Z-slot pin 18 is in position 8*d* in Z-slot 8 as depicted in FIG. 17 and drag block lug 53 is positioned within J-slot 100, as depicted in FIG. 21, retrievable modular packer/bridge plug apparatus 10 of the present invention is in the configuration depicted in FIGS. 11A through 11C.

Figure 11C:
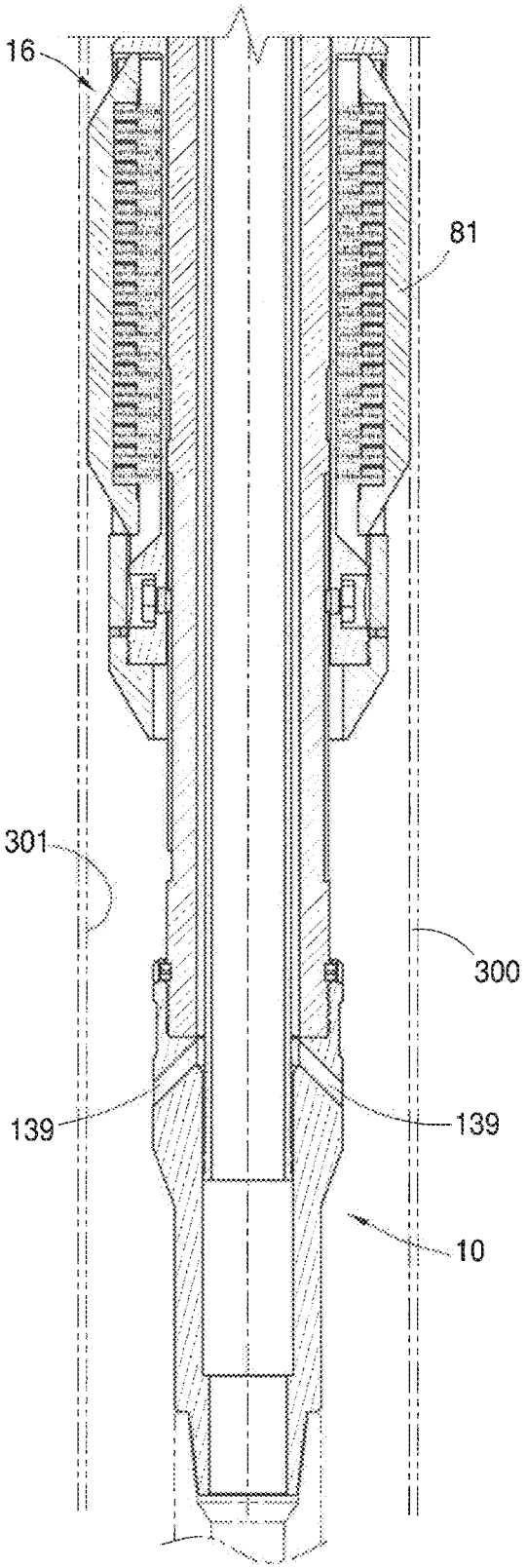

FIG. 11A through 11C depict a side sectional view of the retrievable modular packer/bridge plug apparatus 10 of the present invention in a lower tool set configuration. In this configuration, the internal fluid bypass (flow path) of the retrievable modular packer/bridge plug apparatus 10 is substantially closed to fluid flow. Put another way, fluid cannot easily flow through said internal bypass; seal 27 cooperates with first opposing bore surface 69 of central mandrel 66 to restrict said flow path of said bypass, thereby limiting fluid flow between upper flow ports 73 and lower flow ports 139. It is to be observed that the weight of said work string 400 can be further "slacked off", causing the internal fluid bypass (flow path) of the retrievable modular packer/bridge plug apparatus 10 to be fully closed to fluid flow; in such a configuration, seal 27 cooperates with second opposing bore surface 169 of central mandrel 66 to form a fluid pressure seal and close said fluid flow path between upper flow ports 73 and lower flow ports 139.

Slip assemblies 6 of upper slip assembly 12 are fully retracted, and do not extend radially outward beyond gauge rings 44, gauge rings 97 and/or gauge rings 95. However, in the configuration depicted in FIGS. 11A through 11C, slips 54 are set, and packer elements 88 are exposed to compressive forces and, as a result, are energized. As such, said slips 54 and packer elements 88, as well as drag blocks 81, extend radially outward beyond the predetermined outer diameter (s) of gauge rings 44, gauge rings 97 and gauge rings 95. Further, in this configuration, slips 54 impart gripping force against inner surface 301 of surrounding casing string 300, while energized packer elements form a fluid pressure seal against said inner surface 301. Drag blocks 81 remain in contact with inner surface 301 of surrounding casing string 300.

Thereafter, the weight of said work string 400 can be picked up (causing top sub member 20 to move axially relative to sleeve load sub 30 from position 8*d* back to position 8*c* in Z-slot 8) in order to selectively open the internal fluid bypass/fluid flow path. When Z-slot pin 18 is moved back from position 8*d* to position 8*c* in Z-slot 8, retrievable modular packer/bridge plug apparatus 10 of the present invention is in the configuration depicted in FIGS. 12A through 12C.

Figure 12A:
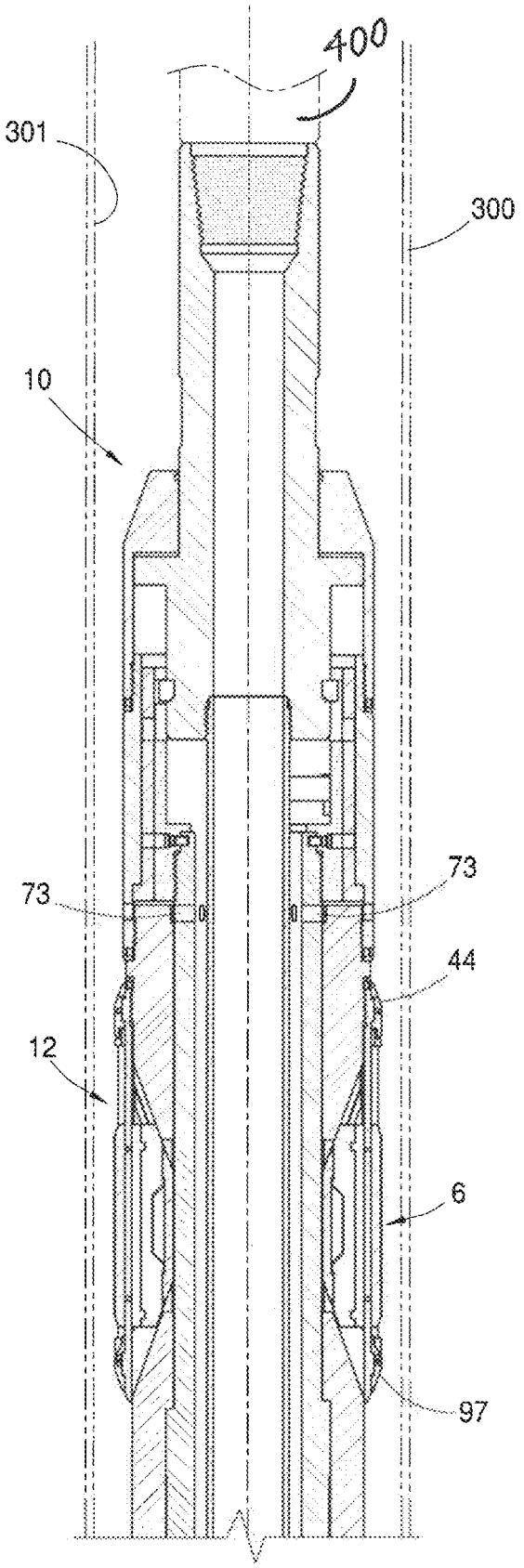
FIG. 12A through 12C depict a side sectional view of the retrievable modular packer/bridge plug apparatus of the present invention in a lower tool set configuration with a bypass flow path open.
Figure 12B:
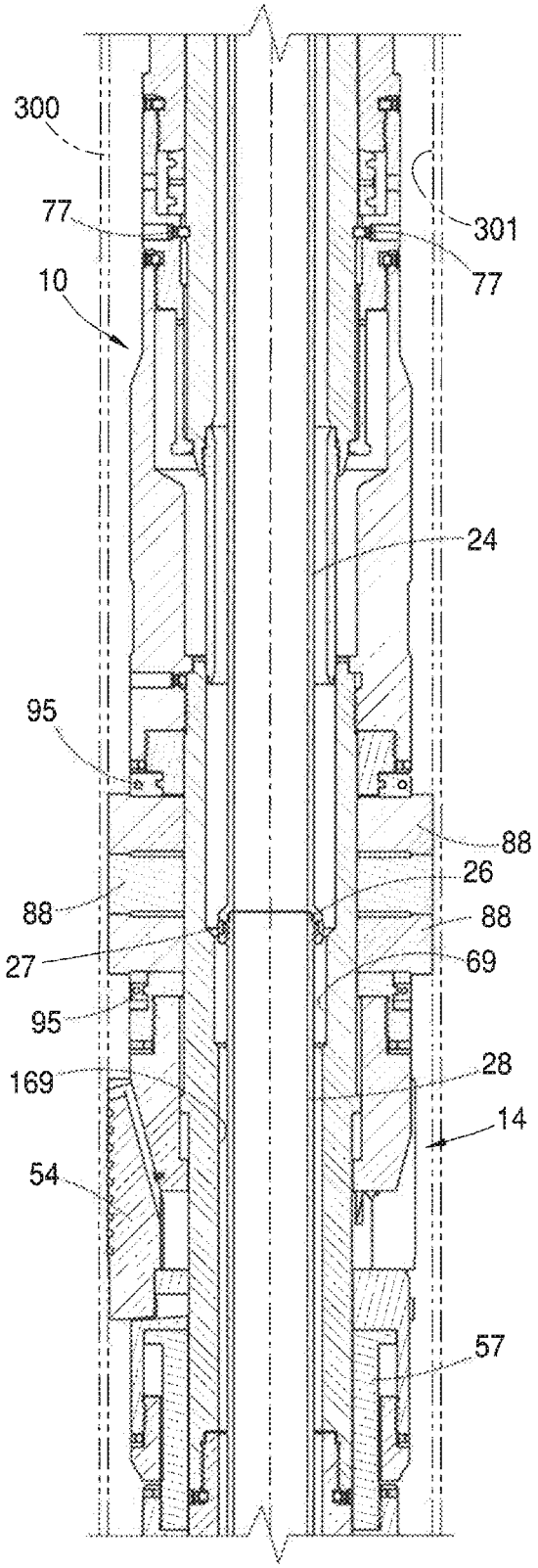
Figure 12C:
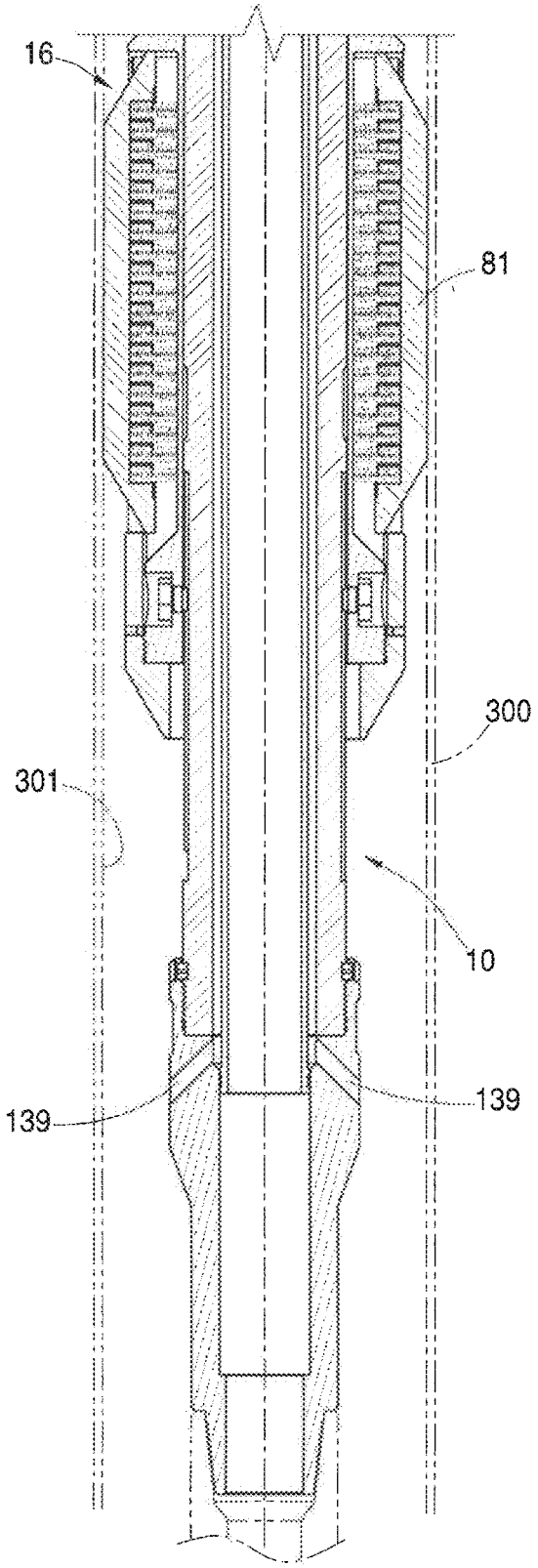

FIG. 12A through 12C depict a side sectional view of the retrievable modular packer/bridge plug apparatus 10 of the present invention in a lower tool set configuration with the bypass flow path open. In this configuration, slip assemblies 6 of upper slip assembly 12 are fully retracted, and do not extend radially outward beyond gauge rings 44, gauge rings 97 and/or gauge rings 95. Slips 54 are set, and packer elements 88 are energized; said slips 54 and packer elements 88, as well as drag blocks 81, extend radially outward beyond the predetermined outer diameter(s) of gauge rings 44, gauge rings 97 and gauge rings 95. Slips 54 impart gripping force against inner surface 301 of surrounding casing string 300, while energized packer elements form a fluid pressure seal against said inner surface 301. Drag blocks 81 remain in contact with inner surface 301 of surrounding casing string 300. However, in this configuration, seal member 27 is not engaged, does not form a fluid pressure seal against second opposing bore surface 169 (or first opposing bore surface 69) of central mandrel 66, and the internal fluid bypass (flow path) of the retrievable modular packer/bridge plug apparatus 10 remains fully open to fluid flow.

In this configuration, fluid cannot be circulated around modular packer/bridge plug apparatus 10. due to energized packer elements 88 that form a fluid pressure seal against said inner surface 301 of casing string 300. However, it is to be observed that fluid can be circulated through said internal fluid bypass (flow path) of retrievable modular packer/bridge plug apparatus 10. Specifically, fluid can be pumped from a drilling rig down the internal bore of a work string 400, through the central through bore of modular packer/bridge plug apparatus 10, into lower flow ports 139, through the inner flow path through said modular packer/bridge plug apparatus 10 (around seal member 27), out upper flow ports 73, and back to the drilling rig through the annulus formed between said work string 400 and a surrounding casing string 300. Similarly, fluid can also be "reverse circulated" through said internal fluid bypass (flow path) of retrievable modular packer/bridge plug apparatus 10. Specifically, fluid can be pumped from a drilling rig through the annulus formed between said work string 400 and a surrounding casing string 300, into upper flow ports 73, through the inner flow path through said modular packer/bridge plug apparatus 10 (around seal member 27), out flow ports 139, through the central through bore of said modular packer/bridge plug apparatus 10, and back to the drilling rig through the internal bore of said work string 400.

Figure 13B:
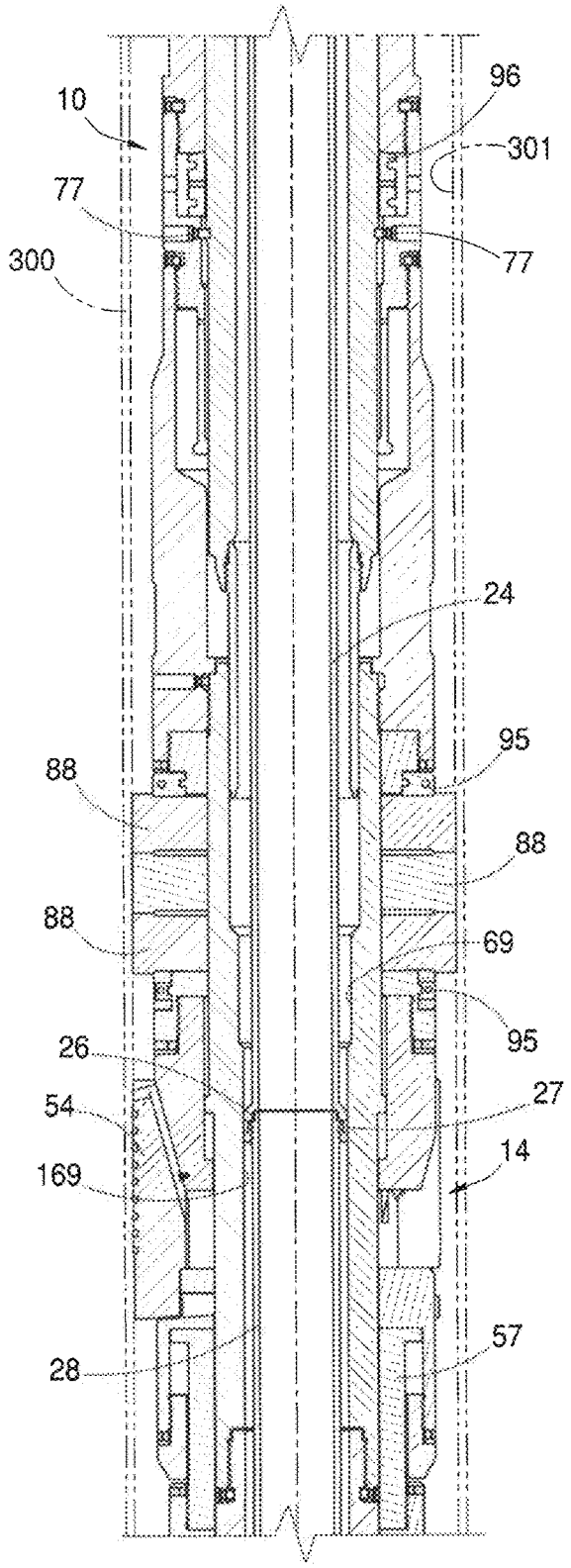
Figure 13C:
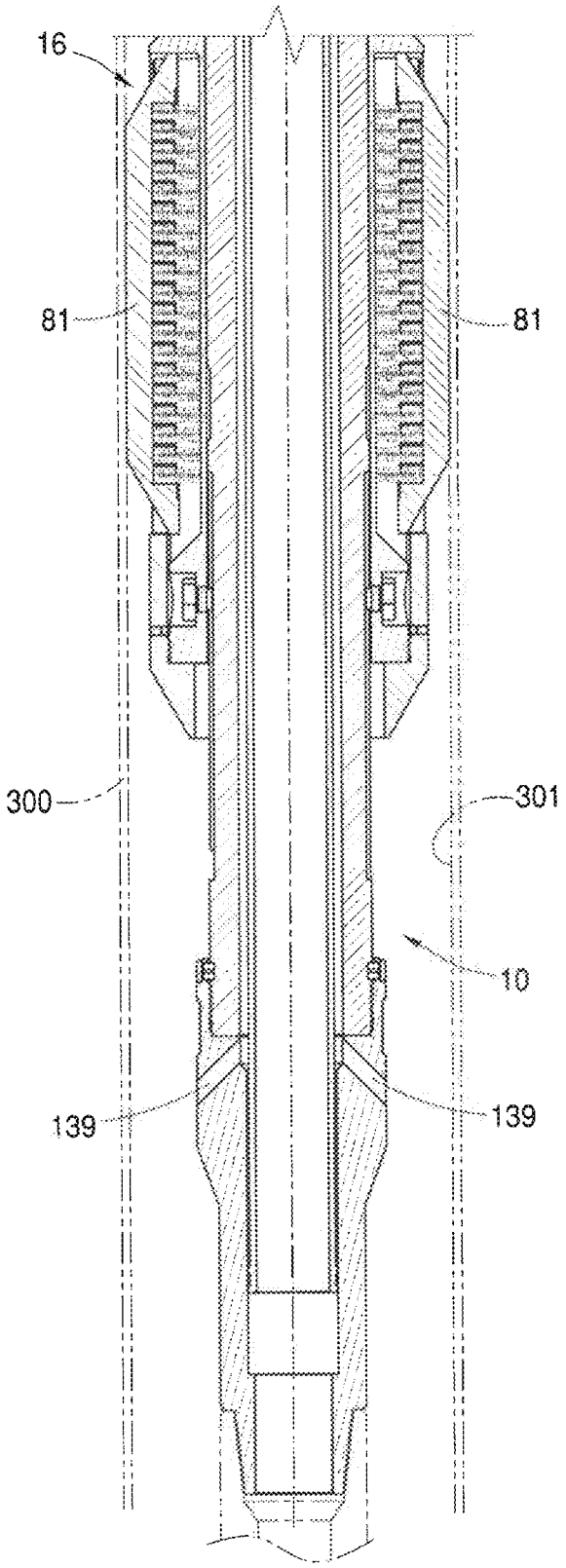

FIG. 13A through 13C depict a side sectional view of the retrievable modular packer/bridge plug apparatus 10 of the present invention in an upper tool set configuration. In this configuration, a predetermined force can be applied to selectively shear the shear pins 77, allowing slip dies 64 of upper slip assembly 12 to be engaged. As such, slip dies 64, lower slips 54, packer elements 88 and drag blocks 81, extend radially outward beyond the predetermined outer diameter(s) of gauge rings 44, gauge rings 97 and gauge rings 95. Slip dies 64 and slips 54 impart gripping force against inner surface 301 of surrounding casing string 300, while energized packer elements 88 form a fluid pressure seal against said inner surface 301. Drag blocks 81 contact said inner surface 301 of surrounding casing string 300.

In this configuration, seal 27 forms a fluid pressure seal against second opposing bore surface 169 of central mandrel 66, thereby blocking fluid flow between upper flow ports 73 and lower flow ports 139; thus, the internal fluid bypass (flow path) of the retrievable modular packer/bridge plug apparatus 10 is closed, and fluid is not permitted to flow therethrough. When desired, a work string 400 conveying said retrievable modular packer/bridge plug apparatus 10 into a well can be selectively manipulated, causing said Z-slot pin 18 to move from position 8*d* to position 8*e* within Z-slot 8, as depicted in FIG. 18, thereby locking said internal fluid bypass (flow path) in a closed position.

Thus, retrievable modular packer/bridge plug apparatus 10 of the present invention has a plurality of different features that can be selectively and independently actuated. Further, in a preferred embodiment, said retrievable modular packer/bridge plug apparatus 10 has both Z-slot 8 and J-slot 100 that can be operated in tandem and/or independently to control various features and functions of said retrievable modular packer/bridge plug apparatus 10 as more fully set forth herein. Importantly, when operated in tandem, said Z-slot 18 and J-slot 100 can cooperate to facilitate such operation, yet their functionalities and actuation motions do not offset or oppose each other.

FIG. 26 depicts a sectional view of the retrievable modular packer/bridge plug apparatus of the present invention along line 26-26 of FIG. 10C. A plurality of drag blocks 81 are moveably disposed in recesses 199 in drag housing 91. In the configuration depicted in FIG. 26, it is to be observed that said drag blocks 81 extend radially outward beyond the outer surface of drag housing 91 and into contact with inner surface 301 of a surrounding casing string 300.

FIG. 27 depicts a sectional view of the retrievable modular packer/bridge plug apparatus of the present invention along line 27-27 of FIG. 11B. A plurality of slip segments 54 are movably attached to slip cage 55 in spaced arrangement around the circumference of said slip cage 55. In the configuration depicted in FIG. 27, it is to be observed that said slips 54 extend radially outward beyond the outer surface of slip cage 55; said slip segments 54 (including, without limitation, slip buttons 55) contact inner surface 301 of a surrounding casing string 300.

FIG. 28 depicts a sectional view of the retrievable modular packer/bridge plug apparatus 10 of the present invention along line 28-28 of FIG. 13A. A plurality of slip dies 64 are disposed around the circumference of slip cage 98 in spaced relationship. In the configuration depicted in FIG. 28, it is to be observed that said slip dies 64 extend radially outward, and said slip dies 64 (as well as outer surfaces 64*a* thereof) contact inner surface 301 of a surrounding casing string 300.

In a preferred embodiment, the retrievable modular packer/bridge plug apparatus 10 of the present invention generally comprises a body section (which can be formed from multiple connected components) defining an opening therethrough. A mandrel (which can also be formed from multiple connected components) is disposed in said opening of said body section and defines a central flow bore through said apparatus. A first plurality of gripping slips is operationally attached to said body section; each of said gripping slips are configured to be selectively shifted from a first retracted position to a second expanded position wherein said slips extend radially outward from said body section to engage against the inner surface of a surrounding casing string.

Additionally, at least one elastomeric sealing member is also disposed on said body section, wherein said at least one elastomeric sealing member is configured to be selectively shifted from a first retracted position to a second expanded position wherein said at least one elastomeric sealing member extends radially outward from said body section to engage and form a fluid pressure seal against the inner surface of a surrounding casing string.

Said retrievable modular packer/bridge plug apparatus 10 of the present invention can also comprise a second plurality of gripping slips operationally attached to said body section. Each of said second plurality of gripping slips are configured to be selectively shifted from a first retracted position to a second expanded position wherein said slips extend radially outward from said body section to engage against the inner surface of a surrounding casing string. A fluid flow path or bypass extends through said body section, with a shiftable seal assembly configured to selectively seal said flow path against fluid flow. A Z-slot assembly controls at least one operation of said apparatus, while a J-slot assembly for controls at least one operation of said apparatus. Actuation of said J-slot assembly and said Z-slot assembly cooperate and work together but do not conflict with each other.

The modular packer/bridge plug apparatus 10 of the present invention comprises a single tool providing features of a retrievable packer and retrievable bridge plug that can operate independently of each other. In a preferred embodiment, bridge plug functionality of said modular packer/bridge plug apparatus 10 can be selectively "locked out" (including, without limitation, on a drilling rig or other remote location) when desired; for example, said bridge plug feature can be locked out during operations wherein well abandonment is not contemplated, such as casing testing, cement squeeze jobs, and the like. As a result, the retrievable packer functionality of said modular packer/bridge plug apparatus 10 can operate independently of said bridge plug functionality.

During abandonment operations or other circumstances wherein use of a bridge plug is desirable, the bridge plug feature of the present invention can be selectively actuated to permit said abandonment or other operations to be conducted. The bridge plug feature can be activated and/or deactivated multiple times during a single trip within a wellbore utilizing the present invention's unique "lock out" design. Further, the integral bypass of said modular packer/bridge plug apparatus 10 comprises a robust internal fluid flow path that can be independently operated, regardless of whether said bridge plug functionality is actuated, depending upon operational needs.

Additionally, said internal fluid bypass forms a high-capacity flow path that permits high circulation flow rates of drilling mud or other drilling fluid to ensure well control and pressure integrity. Further, said high-capacity fluid flow path increases running speeds of tubular goods which saves valuable rig time when tripping in and/or out of a wellbore. Further, said high-capacity fluid bypass flow path reduces surge pressures when running in a well and swab pressures when pulling out of well, and allows for quicker fluid displacements and negative testing operations.

The modular packer/bridge plug apparatus 10 can be easily and efficiently reconfigured from one casing size range to another (including, without limitation, in the field) without removal and/or addition of specialized components to said device. Many components of the present invention—including, without limitation, gauge rings 44, 97 and 95—can be installed, removed, replaced and/or reconfigured in the field to permit the apparatus to be set in multiple different casing size ranges. As a result, a single tool can be utilized for multiple different "casing string" runs (that is, casing strings having different internal diameter dimensions) without removing the apparatus from a location or requiring another separate apparatus to be brought in for use.

The modular packer/bridge plug apparatus 10 of the present invention reduces costs associated with equipment rentals, increases overall safety (including safety related to long assembly lifts) and creates a true modular system that covers multiple applications with a single apparatus. Said modular packer/bridge plug apparatus 10 can be used on a number of different applications including, without limitation, leak/hole hunting (in casing or other tubulars), positive fluid pressure testing, negative fluid pressure testing, remedial/squeeze cementing, casing shoe pressure integrity tests, and barrier qualification and verification. Said modular packer/bridge plug apparatus 10 eliminates the need for connecting multiple different components into bottom hole assemblies.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A modular multi-function downhole apparatus for use within a casing string comprising:

a) a retrievable bridge plug assembly configured to selectively alternate between a first unset configuration and a second set configuration;

b) a retrievable packer assembly configured to selectively alternate between a first unset configuration and a second set configuration, wherein said retrievable bridge plug assembly and retrievable packer assembly are configured to operate independently of each other; and c) a fluid bypass extending around said retrievable bridge plug assembly and said retrievable packer assembly, wherein said fluid bypass is configured to selectively alternate between an open configuration and a closed configuration, regardless of the configurations of said retrievable bridge plug assembly and said retrievable packer assembly;

d) a J-slot configured to control operation of a plurality of gripping slips;

e) a Z-slot configured to control alternating of said fluid flow path from said open configuration to said closed configuration wherein said J-slot and said Z-slot are configured to be actuated separately.

2. A method for conducting downhole operations in a wellbore comprising:

a) providing a modular multi-function downhole apparatus for use within a casing string, said modular multi-function downhole apparatus comprising:

i) a body section having an upper end, a lower end and a central through bore;

i) a retrievable packer assembly configured to alternate between a first unset position and a second set position, said retrievable packer assembly comprising:

aa) a plurality of gripping slips operationally attached to said body section, wherein said plurality of gripping slips are configured to be selectively shifted from a first retracted position to a second expanded position wherein said plurality of gripping slips extends radially outward from said body section to engage against an inner surface of a casing string in said second set position;

bb) at least one elastomeric packer element disposed on said body section, wherein said elastomeric packer element is configured to be selectively shifted from a first retracted position to a second expanded position wherein said at least one elastomeric packer element extends radially outward from said body section to engage and form a fluid pressure seal against the inner surface of said casing string in said second set position;

iii) a retrievable bridge plug assembly configured to alternate between a first unset position and a second set position, said retrievable bridge plug comprising a second plurality of gripping slips operationally attached to said body section, wherein said second plurality of gripping slips are configured to be selectively shifted from a first retracted position to a second expanded position wherein said second plurality of gripping slips extends radially outward from said body section to engage against the inner surface of said casing string;

iv) a fluid bypass flow path extending through said retrievable bridge plug assembly and said retrievable packer assembly, wherein said fluid bypass flow path is configured to be selectively closed;

v) a J-slot configured to control operation of said plurality of gripping slips;

vi) a Z-slot configured to control alternating of said fluid flow path from said open configuration to said closed configuration, wherein said J-slot and said Z-slot are configured to be actuated separately;

b) conveying said modular multi-function downhole apparatus into a wellbore on a tubular workstring;

c) selectively alternating said retrievable packer assembly from said first unset configuration to said second set configuration.

* * * * *